US007819106B2

(12) United States Patent
Kondo

(10) Patent No.: US 7,819,106 B2
(45) Date of Patent: Oct. 26, 2010

(54) ENGINE CONTROL APPARATUS USING SIGNAL WITH LEVEL CHANGING WITH ENGINE OPERATION

(75) Inventor: Haruhiko Kondo, Kasugai (JP)

(73) Assignee: Denso Corporation, Kariya (JP)

( * ) Notice: Subject to any disclaimer, the term of this patent is extended or adjusted under 35 U.S.C. 154(b) by 478 days.

(21) Appl. No.: 12/068,116

(22) Filed: Feb. 1, 2008

(65) Prior Publication Data

US 2008/0189024 A1 Aug. 7, 2008

(30) Foreign Application Priority Data

Feb. 1, 2007 (JP) ..... 2007-022808

(51) Int. Cl.
*F02D 31/00* (2006.01)
*F02P 5/00* (2006.01)
*G06G 7/70* (2006.01)

(52) U.S. Cl. ..... 123/406.6; 123/352; 123/406.63; 701/102; 701/105; 701/114; 701/115

(58) Field of Classification Search . 123/406.6–406.63, 123/350, 352, 353, 354, 355; 701/101, 105, 701/111, 114, 115
See application file for complete search history.

(56) References Cited

U.S. PATENT DOCUMENTS 4,081,995 A * 4/1978 Griffith et al. ..... 73/114.63
4,273,089 A * 6/1981 Maier ..... 123/406.63
6,445,998 B2 * 9/2002 Ando ..... 701/114
6,493,628 B2 * 12/2002 Ando ..... 701/105
6,498,979 B2 * 12/2002 Ando ..... 701/102
7,089,149 B2 * 8/2006 Sugiura et al. ..... 702/151
7,197,391 B2 * 3/2007 Kunibe et al. ..... 701/114
7,353,104 B2 * 4/2008 Nishimura ..... 701/103
7,366,603 B2 * 4/2008 McDaniel ..... 701/102
7,428,459 B2 * 9/2008 Kondo ..... 701/114
2001/0011206 A1 8/2001 Ando
2006/0167615 A1 7/2006 Kunibe et al.
2007/0175272 A1 * 8/2007 Kondo ..... 73/118.1

FOREIGN PATENT DOCUMENTS

JP 2000-104619 4/2000
JP 2001-200747 7/2001

OTHER PUBLICATIONS

Extended European Search Report dated Aug. 24, 2009, issued in corresponding European Application No. 08001846.8-1263.
Japanese Official Action dated Sep. 9, 2008 issued in corresponding Japanese Application No. 2007 022808 with English translation.

* cited by examiner

*Primary Examiner*—Thomas N Moulis
(74) *Attorney, Agent, or Firm*—Nixon & Vanderhye P.C.

(57) ABSTRACT

In an apparatus for controlling an engine, an irregular-region start detector detects that a predetermined-directed level change in an input signal is synchronized with a start of appearance of an irregular region thereof. An irregular-region end detector detects that a predetermined-directed level change in the input signal is synchronized with an end of the irregular region thereof. A fixing unit fixes a reference interval to a predetermined value when it is detected that the predetermined-directed level change in the input signal is synchronized with the start of appearance of the irregular region thereof. A resetting unit resets the reference interval from the predetermined-value to one of the measured intervals when it is detected that the predetermined-directed level change in the input signal is synchronized with the end of the irregular region thereof.

11 Claims, 14 Drawing Sheets

ECU
1
30
MICROCOMPUTER
CPU
100
FLAG
FLAG
F1
F2
FLASH ROM
400
TA
RAM
500
COUNTER
30a
ANGLE CLOCK GENERATING UNIT
200
TIMER OUTPUT UNIT
300
INPUT CIRCUIT
10
OUTPUT CIRCUIT
20
ENGINE (CONTROL TARGET)
E
(OTHER SENSORS)
11
11a
11b
11c
11d
CS
CM1
CM2
12
13

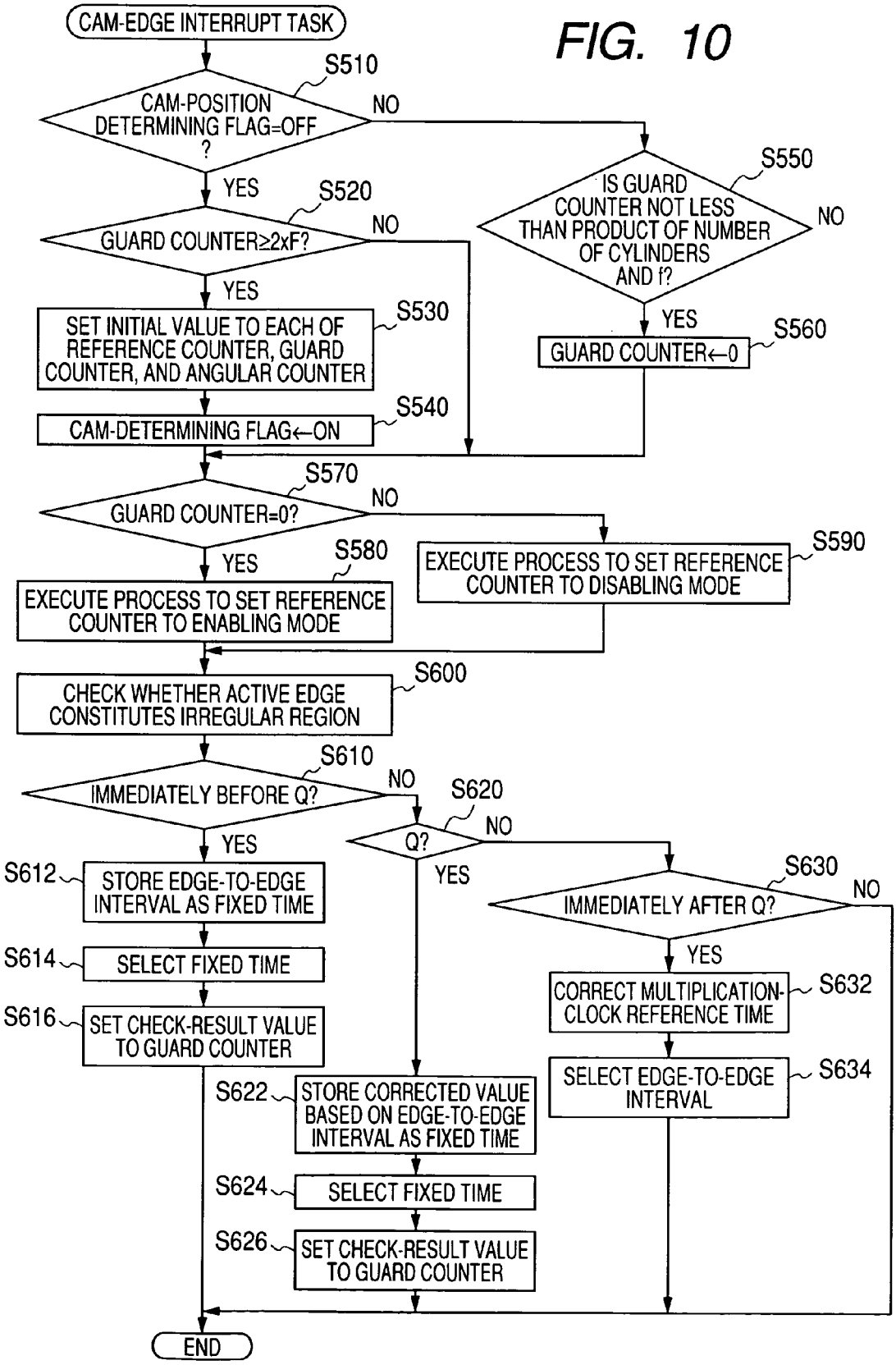
FIG. 10
CAM-EDGE INTERRUPT TASK
S510
CAM-POSITION DETERMINING FLAG=OFF ?
NO
YES
S520
GUARD COUNTER≥2xF?
NO
YES
S530
SET INITIAL VALUE TO EACH OF REFERENCE COUNTER, GUARD COUNTER, AND ANGULAR COUNTER
S540
CAM-DETERMINING FLAG←ON
S550
IS GUARD COUNTER NOT LESS THAN PRODUCT OF NUMBER OF CYLINDERS AND f?
NO
YES
S560
GUARD COUNTER←0
S570
GUARD COUNTER=0?
NO
YES
S580
EXECUTE PROCESS TO SET REFERENCE COUNTER TO ENABLING MODE
S590
EXECUTE PROCESS TO SET REFERENCE COUNTER TO DISABLING MODE
S600
CHECK WHETHER ACTIVE EDGE CONSTITUTES IRREGULAR REGION
S610
IMMEDIATELY BEFORE Q?
NO
YES
S612
STORE EDGE-TO-EDGE INTERVAL AS FIXED TIME
S614
SELECT FIXED TIME
S616
SET CHECK-RESULT VALUE TO GUARD COUNTER
S620
Q?
NO
YES
S622
STORE CORRECTED VALUE BASED ON EDGE-TO-EDGE INTERVAL AS FIXED TIME
S624
SELECT FIXED TIME
S626
SET CHECK-RESULT VALUE TO GUARD COUNTER
S630
IMMEDIATELY AFTER Q?
NO
YES
S632
CORRECT MULTIPLICATION-CLOCK REFERENCE TIME
S634
SELECT EDGE-TO-EDGE INTERVAL
END

FIG. 11

| | | | | | | | | |
|---|---|---|---|---|---|---|---|---|
| FIRST CAM SIGNAL | ↑ | ↑ | ↓ | ↓ | L | H | L | H |
| SECOND CAM SIGNAL | L | H | L | H | ↑ | ↑ | ↓ | ↓ |
| CHANGE POINT | P(P2) | P | Q | P(P1) | P(P2) | P | Q | P(P1) |
| GUARD COUNTER | 0 | 4800 | 6900 | 2400 | 3600 | 1200 | 3300 | 6000 |
| REFERENCE COUNTER | 6000 | 3600 | 5700 | 1200 | 2400 | 0 | 2100 | 4800 |
| ANGULAR COUNTER | 6000 | 3600 | 5700 | 1200 | 2400 | 0 | 2100 | 4800 |

T

↑: RISING EDGE ↓: TRAILING EDGE

L: LOW LEVEL H: HIGH LEVEL

ENGINE CONTROL APPARATUS USING SIGNAL WITH LEVEL CHANGING WITH ENGINE OPERATION

BACKGROUND OF THE INVENTION

Cross Reference To Related Application

This application is based on Japanese Patent Application 2007-022808 filed on Feb. 1, 2007 and claims the benefit of priority therefrom, so that the descriptions of which are all incorporated herein by reference.

1. Field of the Invention

The present invention relates to apparatuses for controlling an engine based on a signal having a level changing with operations of the engine.

2. Description of the Related Art

Engine control units for vehicles use a crank signal whose signal level varies in a predetermined same direction at regular rotation angles (regular crank angles) of an engine crankshaft. When the crank signal is measured by a crankshaft sensor connected to an engine control unit, the measured crank signal is input to the engine control unit.

Based on the input crank signal, the engine control unit works to identify a rotational position (crank position) of the crankshaft; this rotational position has a resolution higher than that obtained based on the angular intervals of the crankshaft.

Specifically, the engine control unit measures a time interval from when a predetermined-directed level change appears in the crank signal and a next predetermined-directed level change appears therein. On the basis of the measured time interval, the engine control unit generates an angle clock as an operation clock; this angle clock consists of a train of clock pulses whose clock cycle is determined by dividing, by a predetermined multiplication number, the measured time interval.

The clock cycle of the angle clock is determined by dividing, by the predetermined multiplication number, the time interval between temporally adjacent predetermined-directed level changes in the crank signal. For this reason, the crank position of the crankshaft is shifted by an angle at every clock cycle of the angle clock; this angle is defined as an angular resolution of the rotation of the crankshaft.

Specifically, the number of active edges, such as rising edges, of the angle clock have been counted for each cycle of the engine. This makes possible that the crank position of the crankshaft corresponding to each of the count values is identified with a high resolution.

Note that the crank signal includes a regular region in which its signal level varies in a predetermined same direction at regular rotation angles of the crankshaft and an irregular region in which its signal level varies in the predetermined same direction at a rotation angle greater than the regular rotation angle.

When the engine control unit generates an angle clock whose clock cycle is determined by dividing, by a predetermined multiplication number, a measured time interval between temporally adjacent predetermined-directed level changes in the irregular region of the crank signal, the clock cycle of the angle clock during the irregular region of the crank signal is longer than that of the angle clock during the regular region of the crank signal.

During the irregular region of the crank signal, even though the crank position is regularly shifted with the operation of the engine as the regular region, an active edge of the angle clock is counted to be delayed from a corresponding actual crank position of the crankshaft. This results that a crank position of the crankshaft corresponding to the count value of an active edge of the angle clock is deviated from a corresponding actual crank position of the crankshaft.

The deviation between an actual crank position of the crankshaft and a crank position thereof determined based a count value of the angle clock during the irregular region of the crank signal may cause an event, such as fuel injection, ignition, or the like, to occur at an abnormal timing. This may contribute to improper engine control.

In order to address such a problem, for example, Japanese Patent Application Publication No. 2001-200747 discloses an engine control unit. The engine control unit is designed to divide, by a predetermined ratio, a measured time interval between temporally adjacent predetermined-directed level changes in the irregular region of the crank signal. The predetermined ratio is a ratio of a time interval between temporally adjacent predetermined-directed level changes in the irregular region of the crank signal to that between temporally adjacent predetermined-directed level changes in the regular region of the crank signal.

Specifically, the engine control unit divides, by the predetermined ratio, a measured time interval between temporally adjacent predetermined-directed level changes in the irregular region of the crank signal to obtain a corrected time interval. Thereafter, the engine control unit generates a corrected angle clock whose clock cycle is determined by dividing, by a predetermined multiplication number, the corrected time interval.

This results that, even during the irregular region of the crank signal, an active edge of the corrected angle clock is counted to be substantially synchronized with a corresponding actual crank position of the crankshaft. This makes it possible to prevent a crank position of the crankshaft corresponding to the count value of an active edge of the angle clock from being deviated from a corresponding actual crank position of the crankshaft.

SUMMARY OF THE INVENTION

In the engine control unit disclosed in the JP Patent Application Publication No. 2001-200747, when a time interval between temporally adjacent predetermined-directed level changes in the irregular region of the crank signal is measured, even before the measured time interval is corrected, an angle clock is generated based on the measured time interval before correction.

For this reason, even a period up to the correction, the angle clock generated based on the measured time interval before the correction may cause the accuracy of the angle clock, contributing to the reduction in the engine control accuracy for the engine control unit.

In view of the background, an object of at least one aspect of the present invention is to provide engine control apparatuses, which are capable of generating an operation clock having an accuracy higher than that of operation clocks to be generated by conventional engine control apparatuses.

According to an aspect of the present invention, there is provided an apparatus for controlling an engine. The apparatus includes an interval measuring unit configured to receive an input signal input thereto and composed of a regular region and an irregular region repetitively appearing in time. The input signal has a level that regularly changes in time in a predetermined direction in the regular region thereof every amount of regular operation of the engine. The level of the input signal irregularly changes in time in the predetermined direction in the irregular region thereof with an amount of irregular operation of the engine. The interval measuring unit is configured to sequentially measure an interval between appearance of a predetermined-directed level change in the input signal and that of a temporally next predetermined-directed level change therein. The apparatus includes a multiplication clock generating unit configured to sequentially use one of the measured intervals as a reference interval and to divide, by a multiplication number, the reference interval so as to generate a multiplication clock, the multiplication clock including a train of clock pulses whose clock cycle corresponds to a division of the reference interval by the multiplication number. The apparatus includes an engine control unit configured to control the engine in synchronization with the multiplication clock generated by the multiplication clock generating unit. The apparatus includes an irregular-region start detector configured to detect that a predetermined-directed level change in the input signal is synchronized with a start of appearance of the irregular region thereof. The apparatus includes an irregular-region end detector configured to detect that a predetermined-directed level change in the input signal is synchronized with an end of the irregular region thereof. The apparatus includes a fixing unit configured to fix the reference interval to a predetermined value when it is detected that the predetermined-directed level change in the input signal is synchronized with the start of appearance of the irregular region thereof. The apparatus includes a resetting unit configured to reset the reference interval from the predetermined-value to one of the measured intervals when it is detected that the predetermined-directed level change in the input signal is synchronized with the end of the irregular region thereof.

According to another aspect of the present invention, there is provided a program product embedded in a media accessible by a computer for controlling an engine. The program product includes an interval measuring for instructing a computer to receive an input signal input thereto and composed of a regular region and an irregular region repetitively appearing in time. The input signal has a level that regularly changes in time in a predetermined direction in the regular region thereof every amount of regular operation of the engine. The level irregularly changes in time in the predetermined direction in the irregular region thereof with an amount of irregular operation of the engine. The interval measuring means is configured to instruct a computer to sequentially measure an interval between appearance of a predetermined-directed level change in the input signal and that of a temporally next predetermined-directed level change therein. The program product includes a multiplication clock generating means for instructing a computer to sequentially use one of the measured intervals as a reference interval and to divide, by a multiplication number, the reference interval so as to generate a multiplication clock. The multiplication clock includes a train of clock pulses whose clock cycle corresponds to a division of the reference interval by the multiplication number. The program product includes an engine control means for instructing a computer to control the engine in synchronization with the multiplication clock generated by the multiplication clock generating means. The program product includes an irregular-region start detecting means for instructing a computer to detect that a predetermined-directed level change in the input signal is synchronized with a start of appearance of the irregular region thereof. The program product includes an irregular-region end detecting means for instructing a computer to detect that a predetermined-directed level change in the input signal is synchronized with an end of the irregular region thereof. The program product includes a fixing means for instructing a computer to fix the reference interval to a predetermined value when it is detected that the predetermined-directed level change in the input signal is synchronized with the start of appearance of the irregular region thereof. The program product includes a resetting means for instructing a computer to reset the reference interval from the predetermined-value to one of the measured intervals when it is detected that the predetermined-directed level change in the input signal is synchronized with the end of the irregular region thereof.

BRIEF DESCRIPTION OF THE DRAWINGS

Other objects and aspects of the invention will become apparent from the following description of embodiments with reference to the accompanying drawings in which:

FIG. 10 is a flowchart schematically illustrating a cam-edge interrupt task to be executed by the CPU illustrated in FIG. 1;

FIG. 11 is a table schematically illustrating correspondences between individual initial values of respective counters of angle clock module illustrated in FIG. 3 and individual active edges in the cam-edge signal in a table format according to the embodiment;

DETAILED DESCRIPTION OF EMBODIMENTS OF THE INVENTION

An embodiment of the present invention will be described hereinafter with reference to the accompanying drawings. In the embodiment, the invention is applied to an electronic control unit (ECU) 1, and the ECU 1 serves as an engine control unit operative to control a four-cycle internal combustion engine E installed in a vehicle and having, for example, the first (#1) to sixth (#6) cylinders.

Figure 1:
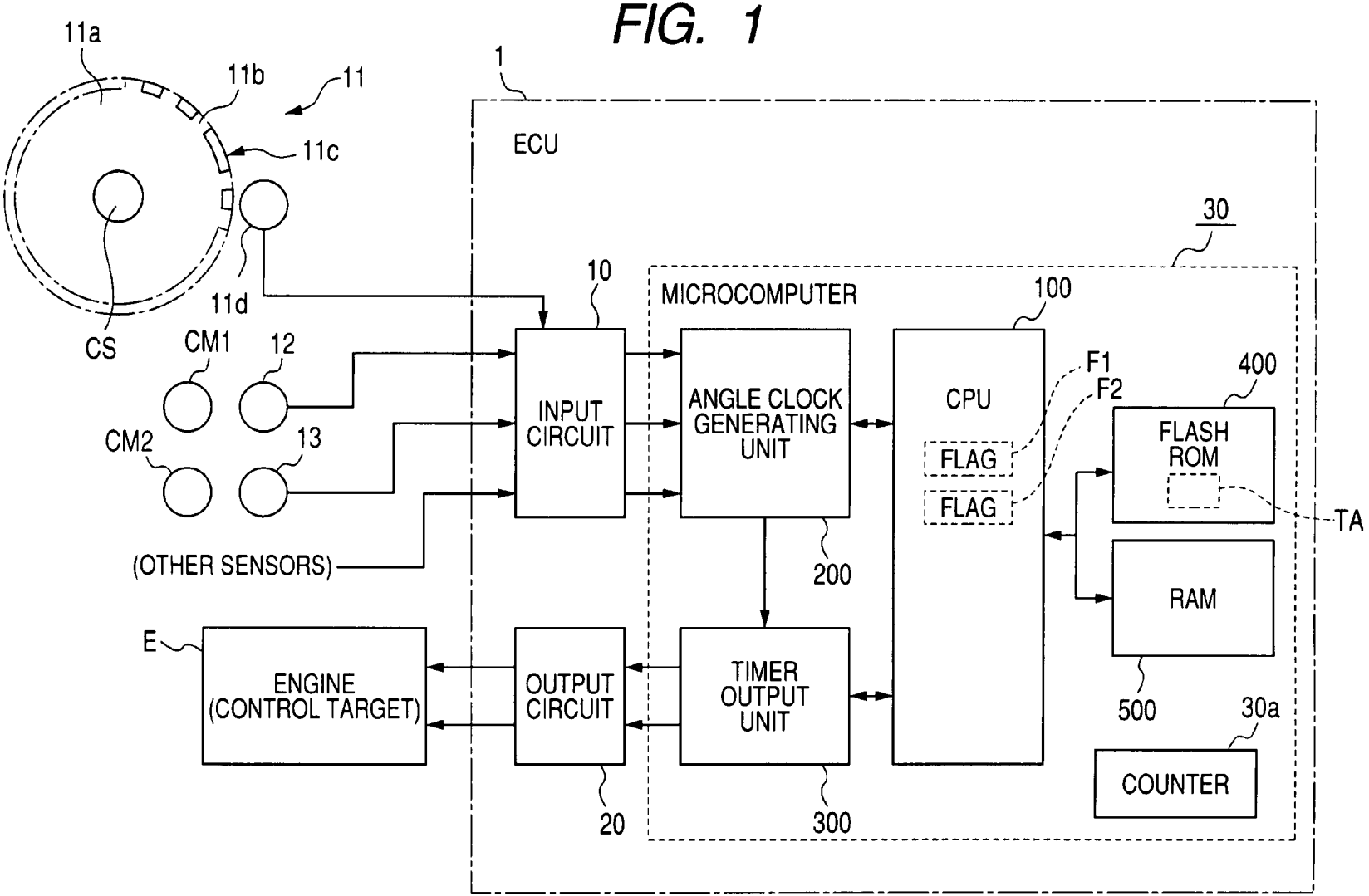
FIG. 1 is a block diagram schematically illustrating an example of the structure of an electronic control unit installed in a vehicle according to an embodiment of the present invention.

FIG. 1 is a block diagram illustrating an example of the structure of the ECU 1, which is installed in advance in the vehicle according to the embodiment of the present invention.

Referring to FIG. 1, the ECU 1 according to the embodiment is provided with an input circuit 10, an output circuit 20, and a microcomputer 30. The input and output circuits 10 and 20 are electrically connected to the microcomputer 30.

The input circuit 10 is electrically connected to a crankshaft sensor 11, a first camshaft sensor 12, a second camshaft sensor 13, and other sensors.

As illustrated in FIG. 1, the crankshaft sensor 11 for example includes a reluctor disc 11*a* having a plurality of teeth 11*b* substantially spaced at angle intervals of, for example, 6 degrees around the periphery of the disc 11*a*. The reluctor disc 11*a* is coaxially mounted on a crankshaft CS serving as the engine's main shaft for delivering rotary motion taken from the reciprocating pistons and rods of the cylinders.

The reluctor disc 11*a* has, for example, a tooth-missing portion 11*c* composed of, for example, k adjacent teeth missing.

The crankshaft sensor 11 for example includes a pickup 11*d* operative to, for example, magnetically detect the teeth 11*b* of the reluctor disc 11*a* on the crankshaft CS as it rotates to generate a crank signal based on the detected result. The crank signal is input to the input circuit 10.

In the embodiment, when the rotational position of the crankshaft CS reaches within a given rotational region so that the tooth-missing portion 11*c* is located in front of the pickup 11*d* to be detectable thereby, the rotational region of the crankshaft CS will be referred to as "specified region" hereinafter.

Because the tooth-missing portion 1I c appears once every rotation angle (crank angle) of the crankshaft CS of 360 degrees (360° CA), the crankshaft CS reaches the specified region every crank angle of 360 degrees. In other words, the crankshaft CS reaches the specified region twice per one engine cycle (the crank angle of 720 degrees).

The first camshaft sensor 12 is operative to, for example, magnetically detect rotational positions of a first camshaft CM1 as it rotates, for example, at one-half rotational speed of the crankshaft CS to generate a first cam signal based on the detected result. The first cam signal is input to the input circuit 10.

Similarly, the second camshaft sensor 13 is operative to, for example, magnetically detect rotational positions of a second camshaft CM2 as it rotates, for example, at one-half rotational speed of the crankshaft CS to generate a second cam signal based on the detected result. The second cam signal is input to the input circuit 10.

Specifically, the first and second camshafts CM1 and CM2 are configured to be driven by gears, belts, and/or a chain from the crankshaft CS, and contain a series of cams for opening and closing the intake and exhaust valves, respectively.

The crank signal is configured to have a level repetitively varying in time like pulses with rotation of the crankshaft CS. Similarly, the first cam signal is configured to have a level repetitively varying in time like pulses with rotation of the first camshaft CM1, and the second cam signal is configured to have a level repetitively varying in time like pulses with rotation of the second camshaft CM2.

Next, the configurations of the crank signal and the first and second cam signals will be described in detail hereinafter with reference to FIG. 2.

Figure 2:
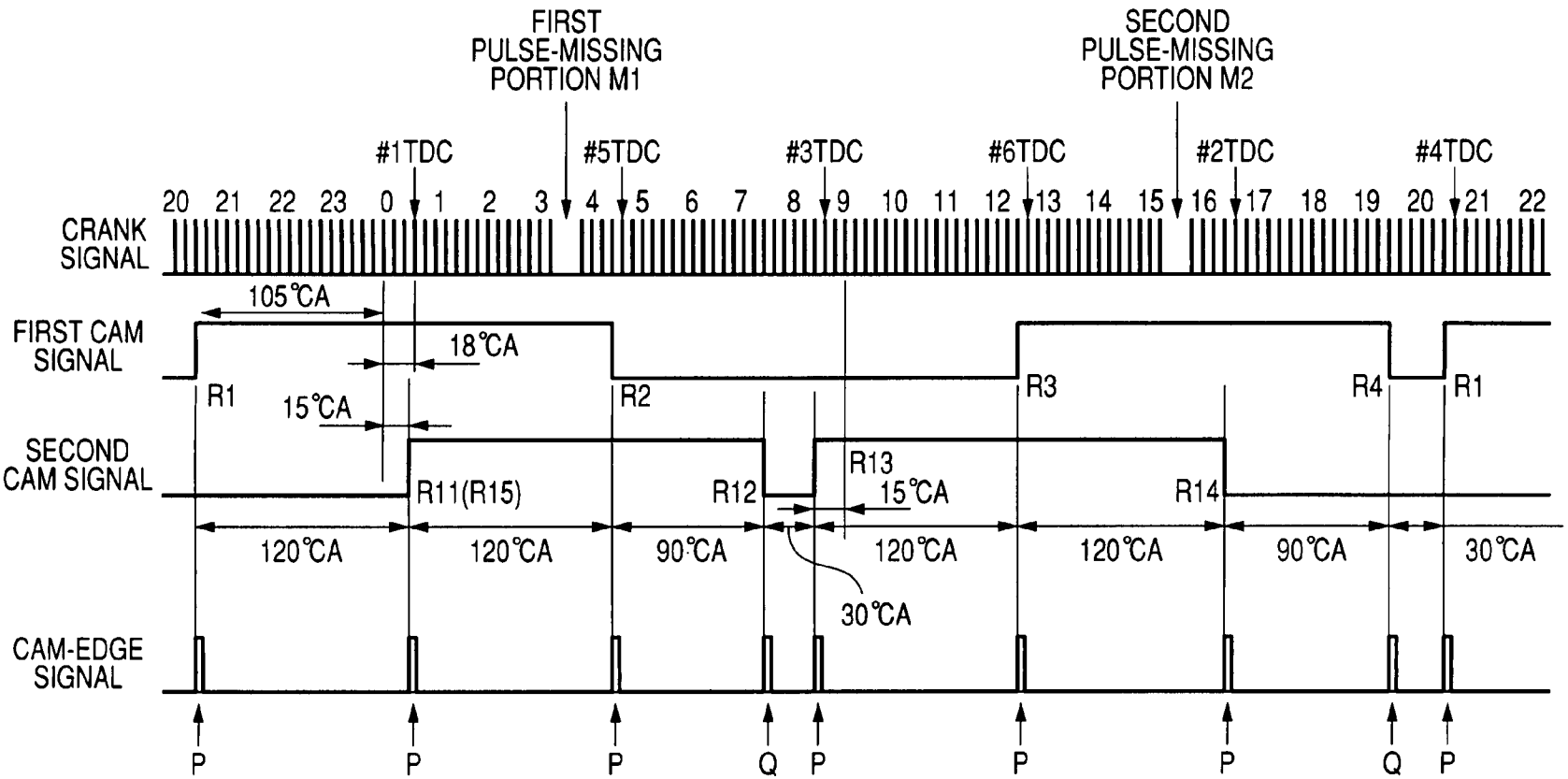
FIG. 2 is a signal waveform chart schematically illustrating a crank signal, first and second cam signals, and a cam-edge signal according to the embodiment of the present invention.

As illustrated in FIG. 2, the level of the crank signal changes in a predetermined same direction in a pulse every time the crank shaft CS (the reluctor disc 11*a*) rotates at a unit angle $\Delta\theta$ degrees crank angle (CA) while the rotational position of the crankshaft CS is not located within the specified region. In the embodiment, for example, the predetermined same direction is set to a high-to-low direction, and the unit angle $\Delta\theta$ degrees crank angle is set to 6 degrees crank angle.

On the other hand, while the rotational position of the crankshaft CS is located within the specified region, a rotational angle of the crankshaft CS that allows the level of the crank signal to change in the same direction (high-to-low direction) in a pulse is k-times greater than the unit angle $\Delta\theta$. In the embodiment, k is set to 3.

In other words, while the rotational position of the crankshaft CS is located within a region except for the specified region, a same-directed active edge, such as a trailing edge, of the transient level change of the crank signal in a pulse appears every time the crankshaft CS rotates at the unit angle $\Delta\theta$.

On the other hand, while the rotational position of the crankshaft CS is located within the specified region, same-directed k-1 active edges of the transient level change of the crank signal do not appear even though the crankshaft CS continuously rotates every unit angle $\Delta\theta$.

Note that same-directed active edges, such as trailing edges or rising edges, appearing in a signal whose level transiently repetitively changes in time like a pulse signal will be referred to merely as "active edges" hereinafter.

This allows a time interval between temporally adjacent active edges of the crank signal while the rotational position of the crankshaft CS is located within the specified region to be k-times greater than a normal time interval. The normal time interval is an interval between temporally adjacent active edges of the crank signal while the rotational position of the crankshaft CS is located within a region except for the specified region.

It is to be noted that a portion (region) of the crank signal corresponding to the specified region, in other words, the k-times time interval between temporally adjacent active edges of the crank signal as compared with the normal time interval will be referred to as a pulse-missing portion (irregular region) M hereinafter.

Because the tooth-missing portion 11*c* appears once every the rotation angle (crank angle) of the crankshaft CS of 360 degrees (360° CA), the pulse-missing portion M also appears, in the crank signal, once every crank angle of 360 degrees.

In the crank signal according to the embodiment, an active edge appearing every time the crankshaft CS rotates at a predetermined crank angle of, for example, 120 degrees CA corresponds to TDC (Top Dead Center) of each of the individual cylinders #1, #5, #3, #6, #2, and #4 in this order in FIG. 2. The predetermined crank angle of 120 degrees can be set by dividing the crank angle of 720 degrees corresponding to one engine cycle by the number of cylinders, such as 6.

A reference position of the crank signal is set to correspond to an active edge a predetermined crank angle of, for example 18 degrees before the active edge corresponding to the TDC of the first cylinder #1. The reference position of the crank signal is illustrated by "0" in FIG. 2.

As described above, the pulse-missing portion M appears, in the crank signal, once every crank angle of 360 degrees. In other words, the pulse-missing portions M are divided into first pulse-missing portions M1 and second pulse-missing portions M2.

In the crank signal, the first pulse-missing portion M1 starts from a first active edge the crank angle of 108 degrees after the active edge appearing at the reference position every engine cycle. The second pulse-missing portion M2 starts from a second active edge the crank angle of 360 degrees after the first active edge every engine cycle.

Specifically, the k-times time interval as compared with the normal time interval after the first active edge corresponds to the first pulse-missing portion M1, and the k-times time interval as compared with the normal time interval after the second active edge corresponds to the second pulse-missing portion M2.

Next, the first cam signal is configured to:

vary from a low level to a high level when the first camshaft CM1 is located at a first rotational position R1 the crank angle of 105 degrees before the reference position;

hold the high level during a first period corresponding to the crank angle of 240 degrees from the high-level turning timing;

vary from the high level to the low level at a second rotational position R2 immediately after the elapse of the first period;

hold the low level during a second period corresponding to the crank angle of 240 degrees from the low-level turning timing;

vary from the low level to the high level at a third rotational position R3 immediately after the elapse of the second period;

hold the high level during a third period corresponding to the crank angle of 210 degrees from the high-level turning timing, vary from the high level to the low level at a fourth rotational position R4 immediately after the elapse of the third period;

hold the low level during a fourth period corresponding to the crank angle of 30 degrees from the low-level turning timing so as to return the first rotational position R1, thereby repeating the series of variations every engine cycle (crank angle of 720 degrees).

The second cam signal is configured to:

vary from a low level to a high level when the second camshaft CM2 is located at a first rotational position R1 the crank angle of 15 degrees after the reference position;

hold the high level during a first period corresponding to the crank angle of 210 degrees from the high-level turning timing;

vary from the high level to the low level at a second rotational position R12 immediately after the elapse of the first period;

hold the low level during a second period corresponding to the crank angle of 30 degrees from the low-level tuning timing;

vary from the low level to the high level at a third rotational position R13 immediately after the elapse of the second period;

hold the high level during a third period corresponding to the crank angle of 240 degrees from the high-level turning timing;

vary from the high level to the low level at a fourth rotational position R14 immediately after the elapse of the third period;

hold the low level during a fourth period corresponding to the crank angle of 240 degrees from the low-level turning timing so as to return the first rotational position R11, thereby repeating the series of variations every engine cycle (crank angle of 720 degrees).

The other sensors are installed beforehand in the vehicle and arranged to measure various types of physical quantities. These physical quantities are required for the ECU 1 to control the individual control targets. Measurement signals indicative of measurands output from the other sensors are periodically input to the input circuit 10.

The input circuit 10 serves as a waveform shaping circuit. Specifically, the input circuit 10 is operative to apply waveform shaping to the crank signal, the first and second cam signals, and the measurement signals respectively output from the crankshaft sensor 11, the first and second cam sensors 12 and 13, and the other sensors. In addition, the input circuit 10 is operative to output the waveform-shaped signals to the microcomputer 30.

The output circuit 20 is operative to activate control targets associated with engine control, such as actuators including injectors and igniters for the respective cylinders, based on target-control instructions (event instructions) sent from the microcomputer 30.

The microcomputer 30 consists essentially of a CPU 100, an angle clock generating unit 200, a timer output unit 300, a flash ROM 400, and a RAM 500, these units 200, 300, and 400 are electrically connected to the CPU 100.

The CPU 100 is operative to control over-all operations of the microcomputer 30.

The angle clock generating unit 200 is operative to receive the crank signal and the first and second cam signals output from the input circuit 10 so as to generate an angle clock described hereinafter.

The timer output unit 300 is operative to output event instructions in synchronization with the clock cycle of the angle clock generated by the angle clock generating unit 200 on the basis of instructions sent from the CPU 100.

The flash ROM 400 is used as an example of various types of nonvolatile memories. Specifically, the flash ROM 400 has stored therein a plurality of programs. At least one of the programs causes the CPU 100 to execute various tasks including: (1) an input signal diagnosing task, (2) time-synchronized task, (3) crank-edge interrupt task, and (4) cam-edge interrupt task, which will be described hereinafter.

The RAM 500 is operative to be quickly accessible by the CPU 100 and to store therein data processed by the CPU 100.

Figure 3:
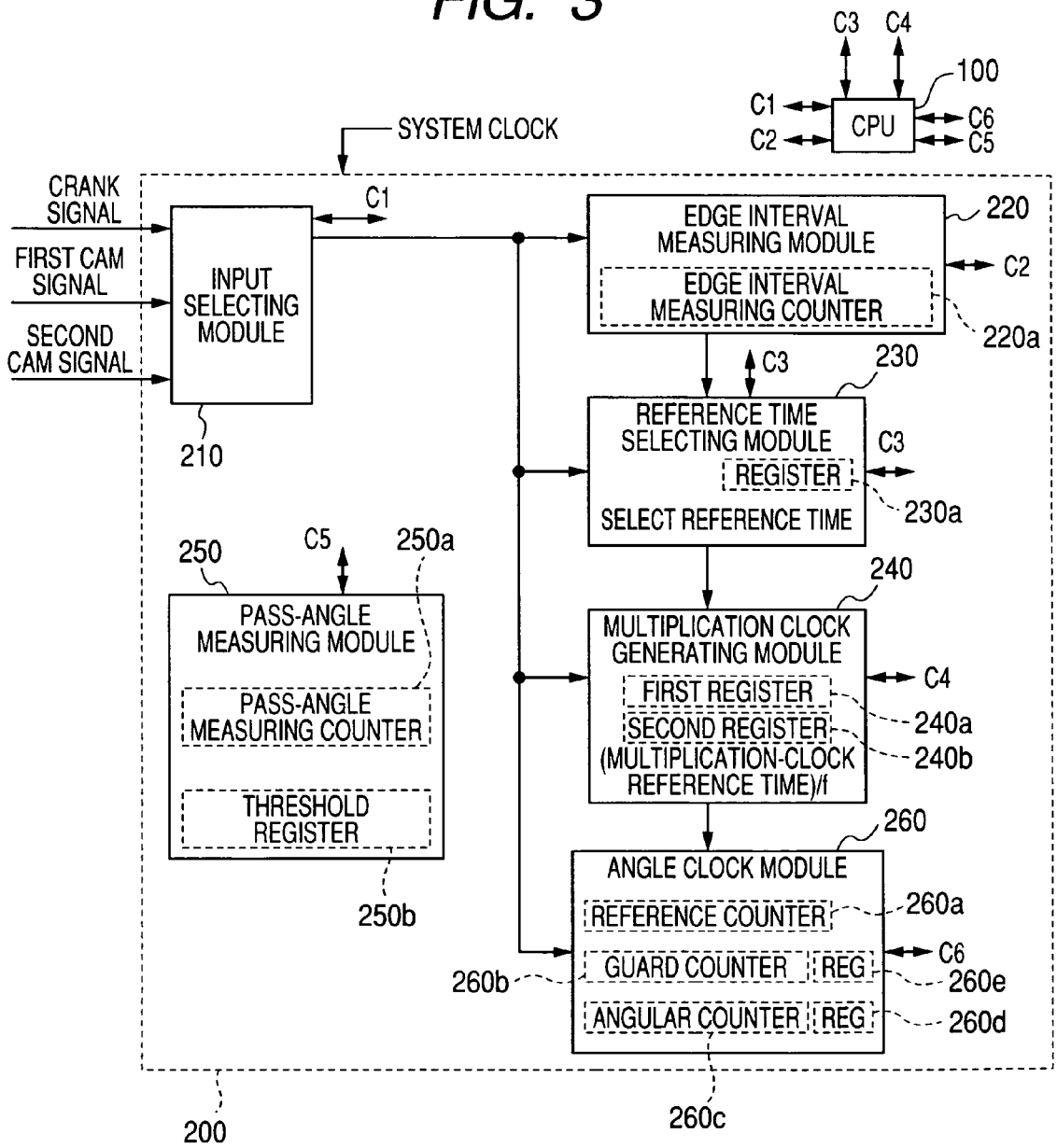
FIG. 3 is a block diagram schematically illustrating an example of the structure of an angle clock generating unit illustrated in FIG. 1.

As illustrated in FIG. 3, the angle clock generating unit 200 includes an input selecting module 210, an edge interval measuring module 220, a reference time selecting module 230, a multiplication clock generating module 240, a pass-angle interrupt module 250, and an angle clock module 260. Each of the modules 210, 220, 230, 240, and 250 is operatively connected to the CPU 100.

The input selecting module 210 is operatively connected to the edge interval measuring module 220, the multiplication clock generating module 240, the pass-angle interrupt module 250, and the angle clock module 260.

The input selecting module 210 is configured to receive the crank signal and the first and second cam signals sent from the input circuit 10.

The input selecting module 210 is also configured to generate a cam-edge signal based on the received first and second cam signals, select one of the received crank signal and the cam-edge signal, and output the selected one of the crank signal and the cam-edge signal to at least one of the modules 220, 230, 240, 250, and 260 based on instructions sent from the CPU 100.

Specifically, the cam-edge signal is configured to have a level transiently vary in time in a predetermined same direction, such as a low-to-high direction, each time a level-variation appears in the individual first and second cam signals. In other words, in the cam-edge signal generated by the input selecting unit 210, a same-directed active edge, such as a rising edge, appears each time a level-inversion appears in the individual first and second cam signals. Same-directed active edges of the cam-edge signal will be referred to merely as "active edges" hereinafter.

Specifically, as illustrated in FIG. 2, the level of the cam-edge signal is configured to transiently change in time in the low-to-high direction at individual change points P and Q corresponding to the individual level-variation timings of the first and second cam signals.

In the embodiment, the cam-edge signal regularly changes in level at a change point P each time one of the first and second cam shafts CM1 and CM2 is rotated by a regular angel of 120 degrees CA. In addition, the cam-edge signal irregularly changes in level at a change point Q each time one of the first and second cam shafts CM1 and CM2 is rotated by a 90 degrees CA after some of the change points P.

Specifically, the cam-edge signal consists of regular regions in which the change points P only appear and irregular regions in which the change points Q appear.

For example, the input-selecting module 210 can be designed to logically OR the first and second cam signals to generate the cam-edge signal.

The input selecting module 210 is further configured to directly output, to the CPU 100, the received crank signal and first and second cam signals.

The edge interval measuring module 220 is operatively connected to the reference time selecting module 230, and includes an edge interval measuring counter 220*a*.

Each time an active edge currently appears in the input signal passed from the input selecting module 210 to the edge interval measuring module 220, the edge interval measuring counter 220*a* works to measure a time interval between the current active edge and the next active edge temporally adjacent thereto appearing in the input signal.

Specifically, each time an active edge currently appears in the input signal, the edge interval measuring counter 220*a* works to:

reset its count value; and, immediately after the reset, count up the number of active edges (trailing edges or rising edges) of clock pulses of a system clock generated by the microcomputer 100 until the next temporally adjacent active edge appears in the input signal.

It is to be noted that the system clock allows synchronization of the tasks in the microcomputer 100 with each other. As described above, the system clock consists of a repetitive series of the clock pulses with a constant clock cycle and a constant clock frequency; this clock frequency is higher than a frequency of active edges in the input signal. The variation of the count value of the edge interval-measuring counter 220*a* is schematically illustrated by T0 to T6 at "EDGE INTERVAL MEASURING COUNTER" in FIG. 4.

As a result, individual time intervals between temporally adjacent current and next active edges in the input signal passed from the input selecting module 210 to the edge interval measuring module 220 are sequentially measured as corresponding individual count values of the edge interval measuring counter 220*a* of the edge interval measuring module 220.

The edge interval measuring module 220 is also operative to pass a count value (measured time interval) of the edge interval measuring counter 220*a* to the reference time selecting module 230 each time a next active edge currently appears in the input signal before reset of the count value.

The reference time selecting module 230 is operatively connected to the multiplication clock generating module 240, and includes a register 230*a*.

Specifically, the reference time selecting module 230 is operative to:

select one of the measured time interval (edge-to-edge interval) output from the edge interval measuring module 220 and a fixed time stored in the register 230*a*; and output, to the multiplication clock generating module 240, the selected one of the measured time interval and the fixed time as a multiplication-clock reference time.

Figure 4:
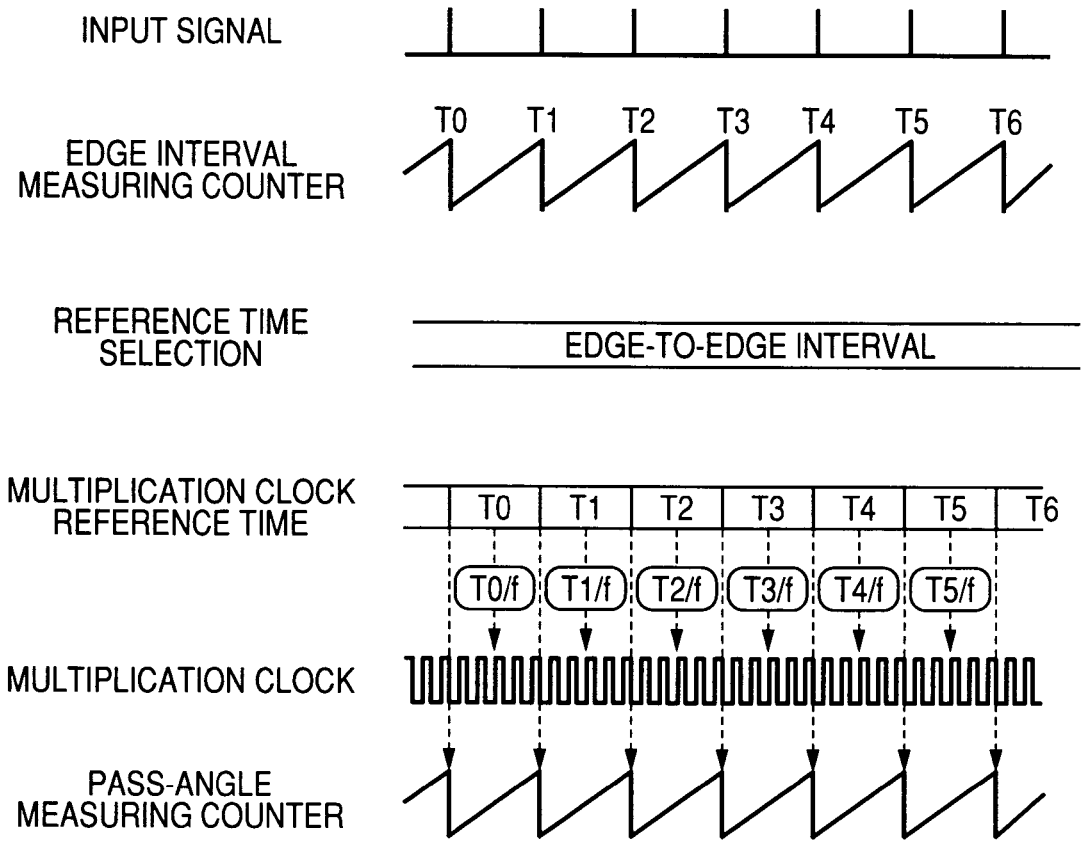
FIG. 4 is a time chart schematically illustrating variations of parameters of an angle clock generating unit with variation of an input signal according to the embodiment of the invention.

For example, in the embodiment, the measured edge-to-edge interval is selected as the multiplication-clock reference time (see "EDGE-TO-EDGE INTERVAL" illustrated at "REFERENCE TIME SELECTION" in FIG. 4).

The multiplication clock generating module 240 is operatively connected to the pass-angle measuring module 250 and the angle clock module 260, and includes first and second registers 240*a* and 240*b*. The second register 240*b* is operative to store therein a multiplication number f. In the embodiment, a default of the multiplication number f is set to 60 for the crank signal, and the multiplication number f for the crank signal whose default is "60" will be specifically expressed by "f1" hereinafter.

Each time the multiplication-clock reference time is passed from the reference time selecting module 230 to the multiplication clock generating module 240, the multiplication clock generating module 240 works to:

receive the multiplication-clock reference time;

store the received multiplication-clock reference time in the first register 240*a* (see "multiplication-clock reference time" in FIG. 4);

divide the multiplication-clock reference time stored in the first register 240*a* by the multiplication number f stored in the second register 240*b* to generate a multiplication clock consisting of a repetitive series of multiplication clock pulses whose clock cycle is a multiplication-number submultiple of the multiplication-clock reference time (see "multiplication clock" in FIG. 4); and output the generated multiplication clock to the pass-angle measuring module 250 and the angle clock module 260.

When the edge-to-edge interval is selected as the multiplication-clock reference-time by the reference time selecting module 230, the multiplication-clock reference time depends on the count value of the edge interval measuring counter 220*a* depending on a corresponding interval of temporally adjacent active edges in the input signal. For this reason, the clock cycle of the multiplication clock depends on change of the multiplication-clock reference time.

For example, as illustrated in FIG. 4, when a count value T0 is stored in the first register 240*a* as the multiplication-clock reference time, the cycle of the multiplication clock is set to T0/f. When the count value T0 stored in the first register 240*a* is updated to a count value T1, the cycle of the multiplication clock signal is changed from T0/f to T1/f.

Similarly, when the count value T1 stored in the first register 240*a* is updated to a count value T2, the cycle of the multiplication clock signal is changed from T1/f to T2/f. The same applies to when count values stored in the first register 240*a* are updated to T3 to T5.

The pass-angle measuring module 250 incorporates a pass-angle measuring counter 250*a* for counting up the number of variations in the multiplication clock in a predetermined same direction, such as a low-to-high direction in the embodiment.

Specifically, the pass-angle measuring counter 250*a* works to:

receive the multiplication clock output from the multiplication clock generating module 240;

reset its count value each time an active edge of the input signal is input thereto via the pass-angle interrupt module 250; and count up the number of rising edges of the multiplication clock pulses of the received multiplication clock until the next temporally adjacent active edge of the input signal is input to the pass-angle measuring counter 250*a* (see "pass-angle measuring counter" in FIG. 4).

As described above, the input signal to be input from the input selecting module 210 to the pass-angle interrupt module 250 is any one of the crank signal and the cam-edge signal. The crank signal is configured to have a level transiently varying repetitively in time with rotation of the crankshaft CS, and the cam-edge signal is configured to have a level transiently varying repetitively in time in a predetermined same direction, such as a low-to-high direction, with rotation of any one of the first and second camshafts CM1 and CM2.

Thus, the multiplication clock has a clock cycle that is an integral submultiple of a corresponding time interval between temporally adjacent active edges in the input signal (any one of the crank signal and the cam-edge signal).

Accordingly, the pass-angle measuring counter 250*a* is operative to measure a rotational angle of the crankshaft CS between each temporally adjacent active edges in the input signal with a high resolution as compared with that as in the case of measuring the rotational angle in synchronization with an active edge of the input signal.

In other words, the pass-angle measuring counter 250*a* is operative to measure a rotational angle of the crankshaft CS passing from 0 degrees crank angle to $\Delta\theta$ degrees crank angle between each temporally adjacent active edges in the input signal with a resolution f-times greater than that as in the case of measuring the rotational angle in synchronization with an active edge of the input signal.

In addition, the pass-angle measuring module 250 includes a threshold register 250*b* for storing a threshold value for the count value of the pass-angle measuring counter 250*a*. The pass-angle measuring module 250 is operative to generate an interrupt when the count value of the pass-angle measuring counter 250*a* is equal to or greater than the threshold value stored in the threshold register 250*b*, thereby outputting the interrupt to the CPU 100.

In the embodiment, a default of the threshold value is set to a predetermined value greater than a reference count value that the pass-angle measuring counter 250*a* can reach while no pulse-missing portions M appear in the crank signal; this reference count value corresponds to $\Delta\theta$ degrees crank angle of the crankshaft CS.

In the embodiment, the default of the threshold value is also set to be smaller than a specified count value that the pass-angle measuring counter 47*a* can reach while one of the pulse-missing portions M appears in the crank signal.

For example, as the default of the threshold value, a value 2.5 times as great as the reference count value $\Delta\theta$ is stored in the threshold register 47*b*; this default of the threshold is given by $2.5\times\Delta\theta$.

The angle clock module 260 includes a reference counter 260*a*, a guard counter 260*b*, and an angular counter 260*c*.

The reference counter 260*a* is operative to count up the number of variations in the multiplication clock in the predetermined same direction, such as the low-to-high direction, in the embodiment.

The guard counter 260*b* is operative to count up by the multiplication number f each time the level of the input signal input thereto from the input selecting module 210 varies in the predetermined direction, such as the low-to-high direction.

The angular counter 260*c* is operative to cause its count value to automatically follow the count value of the reference counter 260*a* in synchronization with an active edge, for example, rising edge of each clock pulse of the system clock.

The angle clock module 260 also includes first and second registers (REG) 260*d* and 260*e*. The first register 260*d* is operative to store therein an upper limit for the reference counter 260*a* and the angular counter 260*c*; this upper limit can be set by instructions sent from the CPU 100. The second register 260*e* is operative to store therein a mode value. The mode value determines the operation mode of the reference counter 260*a*.

The reference counter 260*a* is configured to:

count up the number of rising edges of the multiplication clock input thereto from the multiplication clock generating module 240; and reset its count value to zero (0) in response to the rising edge that appears in the multiplication clock after the count value reaches the upper limit stored in the first register 260*d*.

The reference counter 260*a* is also configured to execute the counting operation in one of the operation modes; this one of the operation modes is determined by the mode value stored in the second register 260*e*.

In the embodiment, the operation modes include:

disabling mode in which the reference counter 260*a* disables the counting-up after the count value reaches the count value of the guard counter 260*b*; and enabling mode in which the reference counter 260*a* enables the counting-up even after the count value reaches the count value of the guard counter 260*b*.

In the embodiment, the angular counter 260*c* is configured such that the count values thereof correspond to the rotational positions of the crankshaft CS when the rotational position thereof is represented with the resolution obtained by dividing the unit angle ($\Delta\theta$) degrees crank angle (6 degrees crank angle) by the 60 of the multiplication number f1; this resolution is determined to be "6°/60=0.1° crank angle".

Thus, the count values of the angular counter 260*c* are individually passed to the timer output unit 300 as clock pulses of an angle clock. The timer output unit 300 is operative to receive the angle clock, and to output, to the output circuit 20, an event instruction synchronized with each clock pulse of the angle clock.

When receiving an event instruction sent from the timer output unit 300, the output circuit 20 is operative to activate at least one of the actuators, such as injectors and/or igniters for the respective cylinders, based on the received event instruction sent from the timer output unit 300.

This allows actuator's operation control, such as ignition control and fuel-injection control, in synchronization with rotation of the crankshaft CS with high resolution.

Note that, in place of the count values of the angular counter 260*c*, the count values of the reference counter 260*a* can be individually passed to the timer output unit 300 as clock pulses of an angle clock.

The microcomputer 30 includes a non-edge period measuring counter 30*a* with an initial count value of zero for measuring a non-edge period in the crank signal. The counter 30*a* can be installed as a hardware component or a software component in the microcomputer 30.

Next, various tasks to be executed by the CPU 100 of the microcomputer 30 in accordance with at least one of the programs stored in, for example, the flash ROM 400 will be described hereinafter with reference to FIGS. 5 to 14.

(1) Input Signal Diagnosing Task

First, instructions of an input signal diagnosing task program that allow the CPU 100 to repeatedly execute the input signal diagnosing task at regular intervals of Tc after the microcomputer 30 is booted will be described hereinafter with reference to FIG. 5.

When launching the input signal diagnosing task program, the CPU 100 determines whether an engine speed of the vehicle is equal to or greater than a predetermined value Na. If it is determined that the engine speed is less than the predetermined value Na (the determination in step S110 is NO), the microcomputer 13 exits the input-signal diagnosing task.

In step S110, the engine speed can be calculated by predetermined engine speed calculating operations using the crank signal. For example, the CPU 100 measures the time interval of the crank angle of 360 degrees corresponding to the occurrence cycle of the pulse-missing portions M, and calculates the engine speed based on the measured time interval.

The pulse-missing portions M can be detected in, for example, the following manner. Specifically, intervals between temporally adjacent active edges of the crank signal are measured, and when a current measured interval is equal to or greater than the product of a previous measured interval and a predetermined pulse-missing detecting ratio of, for example, 2, it is determined that the current measured interval corresponds to one of the pulse missing portions M.

Note that the predetermined value Na represents a threshold engine speed allowing a time interval between temporally adjacent trailing edges of the normal crank signal to be sufficiently smaller than the regular interval Tc.

Specifically, when the time interval between temporally adjacent trailing edges of the crank signal is longer than the regular interval Tc, although the crank signal is normal, no trailing edges appears during the passage of the regular interval Tc. For this reason, the diagnosis of the normal crank signal may be erroneously determined as abnormal. Thus, the operation in step S110 can prevent the normal crank signal from being erroneously determined as abnormal.

Otherwise if it is determined that the engine speed is equal to or greater than the predetermined value Na (the determination in step S110 is YES), the CPU 100 proceeds to step S120. In step S120, the CPU 100 determines whether an active edge, such as a trailing edge, appears in the crank signal during the passage of the regular time interval Tc from the previous input-signal diagnosing task to this current input-signal diagnosing task.

If it is determined that an active edge (trailing edge) appears in the crank signal during the passage of the regular time interval Tc (the determination in step S120 is YES), the CPU 100 stores in, for example, the RAM 500 information representing that the crank signal is normal as the diagnosed result in step S130.

Subsequently, the CPU 100 clears the count value of the non-edge period measuring counter 30*a* in step S140, exiting the input-signal diagnosing task. The non-edge period measuring counter 30*a* is configured to be reset each time the microcomputer 30 is booted.

Specifically, the non-edge period measuring counter 30*a* serves as a counter designed to add up the number of times where it is determined that no rising edges appear in the crank signal in the following operations of the input-signal diagnosing task.

Otherwise if it is determined that no active trailing edges appear in the crank signal during the passage of the regular time interval Tc (the determination in step S120 is NO), the CPU 100 checks whether the count value of the non-edge period measuring counter 30*a* exceeds a predetermined value Nb of, for example, 10 in step S150.

If it is checked that the count value of the non-edge period measuring counter 30*a* does not exceed the predetermined value Nb (the checked result in step S150 is NO), the CPU 100 increments the count value of the non-edge period measuring counter 30*a* by 1, exiting the input-signal diagnosing task.

Otherwise if it is checked that the count value of the non-edge period measuring counter 30*a* exceeds the predetermined value Nb (the checked result in step S150 is YES), the CPU 100*a* stores in, for example, the RAM 500, information representing that the crank signal is abnormal as the diagnosed result in step S170, exiting the input-signal diagnosing task.

Figure 5:
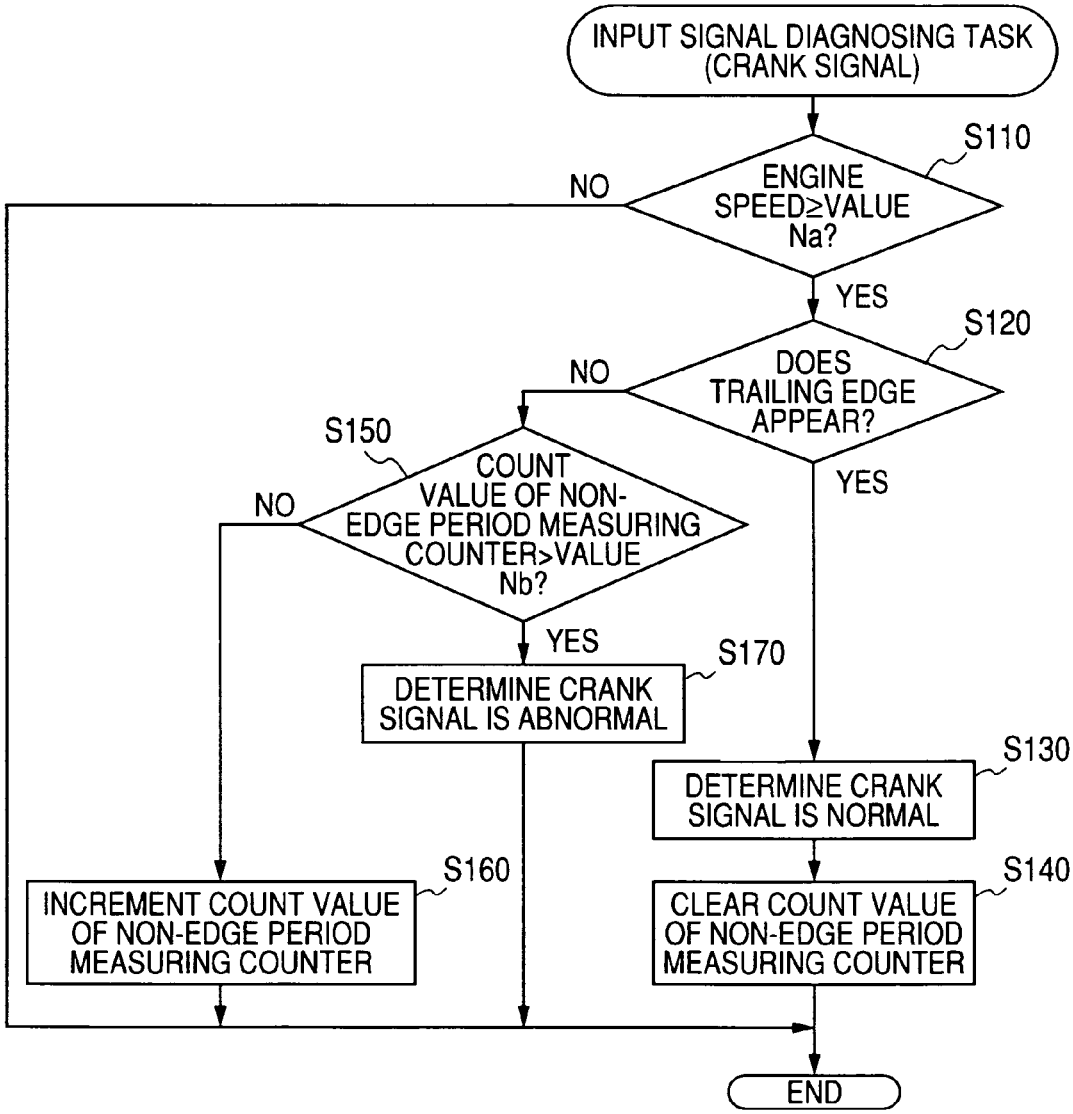
FIG. 5 is a flowchart schematically illustrating an input signal diagnosing task to be executed by a CPU illustrated in FIG. 1.

For example, in the input-signal diagnosing task illustrated in FIG. 5, it is assumed that the engine speed is equal to or greater than the predetermined value Na (the determination in step S110 is YES).

In this case, if no active trailing edges appear in the crank signal after a predetermined period of time has elapsed (the determination in steps S120 is NO and that in S150 is YES), the crank signal is determined to be abnormal (see step S170). Note that the predetermined period of time is represented as the product of the regular time interval Tc and the predetermined value Nb (Tc×Nb), and that an active trailing edge is supposed to appear in the crank signal during the passage of the predetermined period of time.

The CPU 100 carries out the input-signal diagnosing task illustrated in FIG. 5 for the first and second cam signals as in the case of the crank signal (see FIG. 5), thereby determining whether the first and second cam signals are normal. Because the instructions of the input-signal diagnosing task for the first and second cam signals are substantially identical to those for the crank signal, the descriptions of the instructions are omitted.

(2) Time-Synchronized Task

Second, instructions of a time-synchronized task program that allow the CPU 100 to repeatedly execute the time-synchronized task at regular intervals in parallel with the input-signal diagnosing task will be described hereinafter with reference to FIG. 6.

When launching the time-synchronized task program, the CPU 100 refers to the information stored in the RAM 500 and representing the diagnosed result for the crank signal (see steps S130 and S170 in FIG. 5), thereby determining whether the crank signal is abnormal based on the referred result in step S210.

If it is determined that the crank signal is normal (the determination in step S210 is NO), the CPU 100 proceeds to step S220. In step S220, the CPU 100 sends, to the input selecting module 210, a crank-signal selection instruction to select the crank signal as the input signal. In addition, in step S220, the CPU 100 sends, to each of the modules 220, 230, 240, 250, and 260, the crank-signal selection instruction. Thereafter, the CPU 100 exits the time-synchronized task.

The crank-signal selection instruction received by the input selecting module 210 allows the module 210 to select the crank signal as the input signal, thereby passing the selected crank signal as the input signal to each of the modules 220, 230, 240, 250, and 260.

The crank-signal selection instruction received by the multiplication clock generating module 240 allows the module 240 to store, as the multiplication number f1, 60 for the crank signal in the second register 240*b*.

The crank-signal selection instruction received by the angle clock module 260 allows the module 260 to store, in the first register 260*d*, an upper limit of each of the reference counter 260*a* and the angular counter 260*c*; this upper limit is determined for the crank signal. Note that, in the embodiment, the upper limit for the crank signal is given by a value determined by dividing a 360 degrees crank angle corresponding to one rotation of the crankshaft CS by 0.1° CA resolution based on the angular counter 260*c*. That is, the upper limit for the crank signal is determined to be "360/0.1=3600".

Otherwise if it is determined that the crank signal is abnormal (the determination in step S210 is YES), the CPU 100 proceeds to step S230.

In step S230, the CPU 100 refers to the information stored in the RAM 500 and representing the diagnosed result for each of the first and second cam signals to determine whether at least one of the first and second cam signals is abnormal based on the referring result.

If it is determined that both the first and second cam signals are normal (the determination in step S230 is NO), the CPU 100 proceeds to step S240. In step S240, the CPU 100 sends, to the input selecting module 210, a cam-edge signal selection instruction to select the cam-edge signal as the input signal. In addition, in step S240, the CPU 100 sends, to each of the modules 220, 230, 240, 250, and 260, the cam-edge signal selection instruction. Thereafter, the CPU 100 exits the time-synchronized task.

The cam-edge signal selection instruction received by the input selecting module 210 allows the module 210 to select the cam-edge signal as the input signal, thereby passing the selected cam-edge signal as the input signal to each of the modules 220, 230, 240, 250, and 260.

The cam-edge signal selection instruction received by the multiplication clock generating module 240 allows the module 240 to store, as the multiplication number f, a value for the cam-edge signal in the second register 240*b*. In the embodiment, the multiplication number f for the cam-edge signal will be specifically expressed by "f2" hereinafter.

The value as the multiplication number f2 for the cam-edge signal stored in the second register 240*b* is obtained by:

calculating the product of an angular interval of 120 degrees crank angle between arbitrary two temporally adjacent points P in the cam-edge signal and the multiplication number 60 for the crank signal; and dividing the obtained product by the unit angle of 6 degrees crank angle.

That is, the multiplication number f2 for the cam-edge signal is determined to be "(120×60)/6=1200".

The cam-edge signal selection instruction received by the angle clock module 260 allows the module 260 to store, in the first register 260*d*, an upper limit of each of the reference counter 260*a* and the angular counter 260*c*; this upper limit is determined for the cam-edge signal. Note that, in the embodiment, the upper limit for the cam-edge signal is given by a value determined by dividing 720 degrees crank angle corresponding to one rotation of the each of the first and second camshafts CM1 and CM2 by 0.1° CA resolution based on the angular counter 260*c*. That is, the upper limit for the cam-edge signal is determined to be "720/0.1=7200".

Otherwise if it is determined that at least one of the first and second cam signals is abnormal (the determination in step S230 is YES), the CPU 100 exits the time-synchronized task.

(3) Crank-Edge Interrupt Task

Third, instructions of a crank-edge interrupt task program will be described hereinafter with reference to FIG. 7. The instructions allow the CPU 100 to execute the crank-edge interrupt task each time an active edge appears in the crank signal output from the input selecting module 210 as the input signal (see step S220 in FIG. 6) after the microcomputer 30 is booted, When an appearance of an active edge in the crank signal (input signal) triggers to launch the crank-edge interrupt task program, the CPU 100 determines whether the trigger active edge represents the end of a pulse-missing portion Ma in the crank signal in step S310

Figure 8:
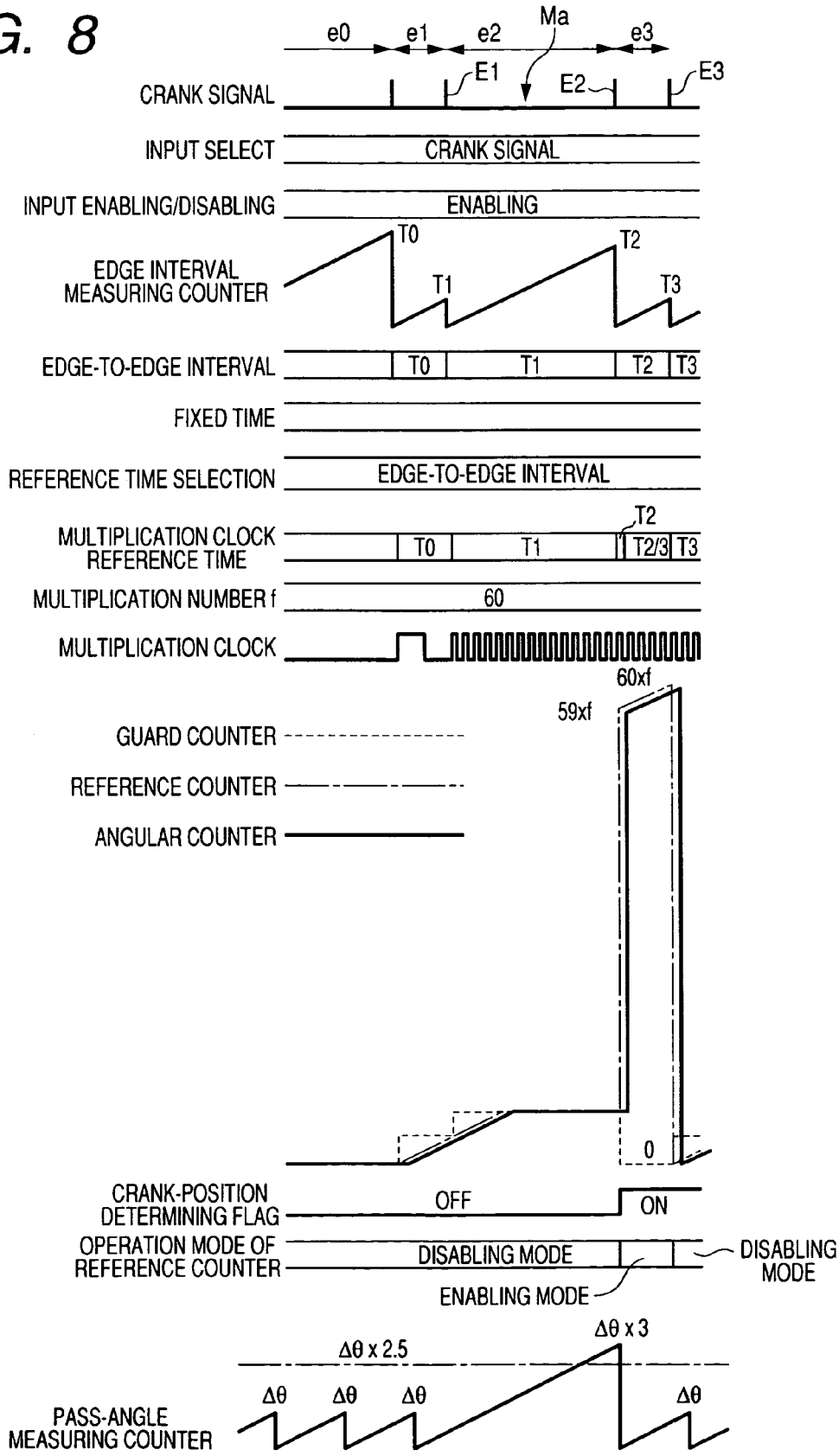
FIG. 8 is a time chart schematically illustrating variations of parameters of the angle clock generating unit with variation of the input signal during the crank-edge interrupt task illustrated in FIG. 7.

Note that, as illustrated in FIG. 8 for example, it is assumed that temporally adjacent active edges E1 and E2 in the crank signal constitute a pulse-missing portion Ma therein.

In this assumption, the time interval of the pulse-missing portion Ma between the active edges E1 and E2 corresponds to a measured count value T1 of the edge interval measuring counter 220*a*. Intervals between temporally adjacent active edges of other portions except for the pulse-missing portions M in the crank signal respectively correspond to measured count values T0, T2, T3, T4, . . . .

As clearly seen in FIG. 8, the time interval of the pulse-missing portion Ma in the crank signal is longer than the intervals of the other portions except for the pulse-missing portions M therein. For this reason, the count value T1 corresponding to the time interval of the pulse-missing portion Ma in the crank signal is greater than the other count values each corresponding to one of the other portions therein.

As described above, a measured value (count value) of the pass-angle measuring counter 250*a* depends on a corresponding time interval between temporally adjacent same-directed edges in the crank signal. For this reason, a count value of the pass-angle measuring counter 250*a* corresponding to the time interval of the pulse-missing portion Ma in the crank signal is greater than that of the counter 250*a* corresponding to another time interval of another portion in the crank signal except for the pulse-missing portions M.

For this reason, the count value of the pass-angle measuring counter 250*a* corresponding to the time interval of the pulse-missing portion Ma in the crank signal exceeds the default (Δθ×2.5) of the threshold value stored in the threshold register 250*b*. For example, the count value of the pass-angle measuring counter 250*a* corresponding to the time interval of the pulse-missing portion Ma in the crank signal is illustrated by "Δθ×3" in FIG. 8.

As a result, when the count value of the pass-angle measuring counter 250*a* corresponding to the time interval of the pulse-missing portion Ma in the crank signal reaches the default of the threshold value, the pass-angle measuring module 250 generates an interrupt, thereby outputting it to the CPU 100.

Accordingly, when receiving the interrupt output from the pass-angle measuring module 250, the CPU 100 determines that the trigger active edge represents the end of a pulse-missing portion M in the crank signal (the determination in step S310 is YES).

For example, as illustrated in FIG. 8, an active edge E2 is the trigger active edge representing the end of a pulse-missing portion Ma.

Subsequently, the CPU 100 determines whether a crank-position determining flag F1 holds information indicative of OFF in step S320. It is to be noted that the crank-position determining flag F1 is for example set by software in the microcomputer 30 each time the microcomputer 30 is booted. The information indicative of OFF is set as default information of the crank-position determining flag F1 during the microcomputer's start-up process.

If it is determined that the crank-position determining flag F1 holds the information indicative of the default of OFF (the determination in step S320 is YES), the CPU 100 determines a timing immediately after microcomputer startup, proceeding to step S330.

In step S330, the CPU 100 sets the product of "59" and the multiplication number f1, which is set to 60 in the crank-edge interrupt task, to the count value of the reference counter 260*a*, Similarly, in step 340, the CPU 100 sets the product of "59" and the multiplication number f1, which is set to 60 in the crank-edge interrupt task, to the count value of the angle counter 260*c*.

The product of "59" and the multiplication number f1 (60) to be set to the count value of the reference counter 260*a* allows the count value thereof to be cleared (zero) when the next active edge E3 appears in the crank signal. Similarly, the product of "59" and the multiplication number f1 (60) to be set to the count value of the angular counter 260*c* allows the count value thereof to be cleared (zero) upon an appearance of the next active edge E3 in the crank signal.

Next, the CPU 100 changes the information held by the crank-position determining flag F1 from OFF to ON in step S350.

After the completion of the execution of the instruction in step S350, or a negative determination representing that the crank-position determining flag F1 does not hold the information indicative of OFF in step S320, the CPU 100 sets "0" to the count value of the guard counter 260*b* in step S360.

The count value of zero (0) set to the guard counter 260*b* represents a count value that each of the reference counter 260*a* and the angular counter 260*c* should take when the next active edge E3 appears in the crank signal.

Specifically, it is assumed that the engine suddenly accelerates at the timing of an appearance of the active edge E2 in the crank signal so that the engine speed suddenly increases. In this assumption, a time interval between the active edge E2 and the next active edge E3 in the crank signal may become short as compared with normal time intervals of active edges therein. This may cause the count value of each of the reference counter 260*a* and the angular counter 260*c* not to catch up with zero (0) at the appearance timing of the next active edge E3; each of the counters 260*a* and 260*c* should take zero (0) at the appearance timing of the next active edge E3.

In this assumption, according to the embodiment, it is possible to forcibly increase the count value of each of the reference counter 260*a* and the angular counter 260*c* to be matched with the guard value of the guard counter 260*b* at the timing when the next active edge E3 appears in the crank signal. This permits the count value of each of the reference counter 260*a* and the angular counter 260*c* to become zero (0) even if a time interval between the active edge E2 and the next active edge E3 in the crank signal becomes short as compared with normal time intervals of active edges therein.

In addition, it is assumed that the engine suddenly decelerates at the timing of an appearance of the active edge E2 in the crank signal so that a time interval between the active edge E2 and the next active edge E3 in the crank signal becomes long as compared with normal time intervals of active edges therein. This may cause the count value of each of the reference counter 260*a* and the angular counter 260*c* to exceed, at the next active edge E3, zero (0) that each of the counters 260*a* and 260*c* should take at the next active edge E3.

In this assumption, according to the embodiment, it is possible to forcibly stop an increment of the count value of each of the reference counter 260*a* and the angular counter 260*c* when the count value reaches the guard value of the guard counter 260*b*. This permits the count value of each of the reference counter 260*a* and the angular counter 260*c* to become zero (0) even if a time interval between the active edge E2 and the next active edge E3 in the crank signal becomes long as compared with normal time intervals of active edges therein.

As described above, the guard counter 260*b* is configured such that its count value at a timing of an appearance of an active edge in the crank signal represents a value that each of the reference counter 260*a* and the angular counter 260*c* should take at a timing of an appearance of the next active edge in the crank signal. This permits the count value of each of the reference counter 260*a* and the angular counter 260*c* to be guarded even if the engine suddenly accelerates or decelerates.

After step S360, the CPU 100 sends, to the angle clock module 260, an instruction indicative of the enabling mode in step S370.

The instruction indicative of the enabling mode and received by the angle clock module 260 allows the module 260 to store, as the mode value, an enabling mode value indicative of the enabling mode in the second register 260*e*. The enabling mode value stored in the second register 260*e* permits the reference counter 260*a* to count in the enabling mode described above even if "0" is set to the count value of the guard counter 260*b*.

Next, the CPU 100 sends, to the reference time selecting module 230, an instruction to select, as the multiplication-clock reference time, the edge-to-edge interval in step S372.

When receiving the instruction, the reference time selecting module 230 transfers, to the multiplication clock generating module 240, the edge-to-edge interval passed from the edge interval measuring module 220 until an instruction to select, as the multiplication-clock reference time, the fixed time is passed thereto from the CPU 100 (see step S414 hereinafter).

Subsequently, the CPU 100 sends, to the multiplication clock generating module 240, an instruction to correct a multiplication-clock reference time stored in the first register 240*a* in step S380. Thereafter, the CPU 100 exits the crank-edge interrupt task.

Specifically, the instruction is to set, as the multiplication-clock reference time to be stored in the first register 240*a*, a value calculated by dividing the edge-to-edge interval passed from the reference time selecting module 230 by a predetermined value.

When receiving the instruction, the multiplication clock generating module 240 works to:

divide, by the predetermined value, the edge-to-edge interval passed at a timing from the reference time selecting module 230; this timing is synchronized with an appearance of an active edge in the crank signal immediately after the reception of the instruction; and store a value calculated by the division in the first register 240*a* as a corrected multiplication-clock reference time.

Specifically, as illustrated in FIG. 8, the count value corresponding to a time interval, such as a T2, of a pulse-missing portion Ma in the crank signal is k-times as much as that corresponding to a time interval, such as a T1, of one of the other portions except for the pulse-missing portion Ma therein. It is to be noted that the width of the time interval "T1" longer than that of the time interval "T2", which is illustrated as "EDGE INTERVAL" in FIG. 8 is independent of the length of the time interval "T1". Specifically, the length of the time interval "T2" is longer than that of the time interval "T1" in FIG. 8.

In the embodiment, therefore, the predetermined value is set to k representing a ratio of a time interval between temporally adjacent active edges of a pulse-missing portion M in the crank signal to that between temporally adjacent active edges of another portion therein; this k is set to 3.

This allows each of the multiplication clock reference times to be substantially constant, so that the multiplication clock whose clock cycle is substantially constant (see "multiplication clock" in FIG. 8).

Otherwise if it is determined that the trigger active edge for the crank-edge interrupt task does not represent the end of a pulse-missing portion M in the crank signal (the determination in step S310 is NO), the CPU 100 determines whether the trigger active edge represents the head of a pulse-missing portion M in step S400.

In the embodiment, the CPU 100 executes the determination in step S400 by, for example, determining whether the count value of the angular counter 260*c* represents a rotational position of the crankshaft CS corresponding to the head of a teeth-missing portion 11*c*. If it is determined that the count value of the angular counter 260*c* represents the rotational position of the crankshaft CS corresponding to the head of a teeth-missing portion 11*c*, the CPU 100 determines that the trigger active edge for the crank-edge interrupt task represents the head of a pulse-missing portion M in step S400.

Specifically, if it is determined that the trigger active edge for the crank-edge interrupt task represents the head of a pulse-missing portion M (the determination in step S400 is YES), the CPU 100 sets the product of "59" and the multiplication number f1, which is set to 60 in the crank-edge interrupt task, to the count value of the guard counter 260*b* in step S410.

This is because the count value of the reference counter 260*a* and the angular counter 260*c* should take the product of "59" and the multiplication number f1 (60) when the next active edge corresponding to the end of a pulse-missing portion M appears in the crank signal.

After the completion of the execution of the instruction in step S410, the CPU 100 sends, to the reference time selecting module 230, an instruction to store, in the register 230*a*, the edge-to-edge interval as the fixed time in step S412; this edge-to-edge interval is passed from the edge interval measuring module 220 in response to the trigger active edge for the crank-edge interrupt task.

When receiving the instruction, the reference time selecting module 230 stores, in the register 230*a*, the edge-to-edge interval as the fixed time.

Thereafter, the CPU 100 sends, to the reference time selecting module 230, an instruction to select, as the multiplication-clock reference time, the fixed time in step S414.

When receiving the instruction, the reference time selecting module 230 transfers, to the multiplication clock generating module 240, the fixed time stored in the register 230*a* until an instruction to select, as the multiplication-clock reference time, the edge-to-edge interval is passed thereto from the CPU 100 (see step S372 set forth above).

After the completion of the execution of the instruction in step S414, or a negative determination in step S400, the CPU 100 sends, to the angle clock module 260, an instruction indicative of the disabling mode in step S420. Thereafter, the CPU 100 exits the crank-edge interrupt task.

The instruction indicative of the disabling mode and received by the angle clock module 260 allows the module 260 to store, as the mode value, a disabling mode value indicative of the disabling mode in the second register 260*e*. The disabling mode value stored in the second register 260*e* permits the reference counter 260*a* to count in the disabling mode described above. Specifically, in the disabling mode, the reference counter 260*a* counts up until its count value reaches the count value of the guard counter 260*b*.

Specific operations of the respective modules 210, 220, 230, 240, 250, and 260 under control of the CPU 100 in the crank-edge interrupt task and variations of the parameters, such as the count values of the counters 220*a*, 260*a*, 260*b*, and 260*c*, will be described hereinafter with reference to FIGS. 7 to 9.

Immediately after the microcomputer 30 is booted (see a section e0 in FIG. 8), the pass-angle measuring module 250 does not normally operate and the angular counter 260*c* does not execute counting operation. For this reason, the determinations in steps S310 and S400 are respective negative, so that execution of the CPU 100 is shifted to step S420, and after completion of the operation in step S420, the crank-edge interrupt task is terminated.

Thereafter, the instructions in step S310, S400, and S420 are repeatedly executed by the CPU 100 in this order each time an active edge appears in the crank signal (see a section e1 in FIG. 8).

During the repeat execution of the instructions in steps S310, S400, and S420, the count value of the pass-angle measuring counter 250*a* exceeds the threshold value stored in the threshold register 250*b* before an active edge E2 appearing in the crank signal represents the end of a pulse-missing portion M (see in FIG. 8). During the repeat execution of the instructions in steps S310, S400, and S420, it is to be noted that, because the count value of the angular counter 260*c* does not represent the head of a pulse-missing portion M, the determination in step S400 is negative.

The excess of the count value of the pass-angle measuring counter 250*a* exceeds the threshold value over the threshold value allows the pass-angle measuring module 250 to generate an interrupt, and to output it to the CPU 100. Thus, the interrupt is received by the CPU 100 so that, when the active edge E2 appears in the crank signal after receipt of the interrupt, it is determined that the active edge E2 represents the end of a pulse-missing portion M in the crank signal (the determination in step S310 is YES). Thus, execution of the CPU 100 is shifted to step S320 and later.

At that time, because the crank-position determining flag F1 is set to the information indicative of OFF, the determination in step S320 is affirmative, so that execution of the CPU 100 is shifted to steps S330 and S340.

In step S330, the count value of the reference counter 260*a* is set to the product of "59" and the multiplication number f1 (60), and the count value of the angular counter 260*c* is set to the product of "59" and the multiplication number f1 (60) in step S340. Thereafter, the crank-position determining flag F1 is set to the information indicative of ON in step S350.

Next, in step S360, the count value of the guard counter 260*b* is set to "0", and the reference counter 260*a* executes the count-up operation in the enabling mode in step S370.

Even if the count value of the guard counter 260*b* is set to "0" in step S360, because the operating mode of the reference counter 260*a* is set to the enabling mode in step S370, the reference counter 260*a* continuously counts up until the count value reaches the upper limit stored in the first register 260*d* (see a section e3 in FIG. 8).

Next, the edge-to-edge interval is selected as the multiplication-clock reference time in step S372, and the multiplication-clock reference time is corrected from T2 to T2/3 in step S380 (see "T2/3" in FIG. 8). Thereafter, the crank-edge interrupt task is terminated.

Because edge-to-edge interval is selected as the multiplication-clock reference time in step S372, the multiplication clock generating module 240 generates, after the operation in step S372, the multiplication clock based on the edge-to-edge interval passed from the edge interval measuring module 220 until the fixed time is selected in step S414.

As described above, after the affirmative determination in which an active edge represents the end of a pulse-missing portion M in the crank signal after microcomputer startup in step S310, the instructions in step S310, S400, and S420 are repeatedly executed by the CPU 100 in this order each time an active edge appears in the crank signal. The repeat execution of the instructions in step S310, S400, and S420 is stopped at step S400 when an active edge appearing in the crank signal represents the head of a pulse-missing portion M therein (see a section e4 in FIG. 9).

When an active edge (E25) (see FIG. 9) appearing in the crank signal represents the head of a pulse-missing portion M therein (the determination in step S400 is YES), the count value of the guard counter 260*b* is set to the product of "59" and the multiplication number f1 (60) in step S410. In addition, the edge-to-edge interval is stored in the register 230*a* of the reference time selecting module 230 as the fixed time in step S412. This allows the fixed time stored in the register 230*a* to be selected as the multiplication-clock reference time (see a section e5 and "FIXED TIME" at "REFERENCE TIME SELECTION" in FIG. 9).

Because the fixed time is selected as the multiplication-clock reference time in step S414, the multiplication clock generating module 240 generates, after the operation in step S414, the multiplication clock based on the fixed time independently of the edge-to-edge interval measured by the edge interval measuring module 220 until the edge-to-edge interval is selected in step S372.

Thereafter, when the next active edge (E26) appears in the crank signal, it is determined that the active edge (E26) represents the end of the pulse-missing portion (the determination in step S310 is YES). At that time, because the crank-position determining flag F1 is set to the information indicative of ON, the determination in step S320 is NO, so that execution of the CPU 100 is shifted to step S360.

Figure 9:
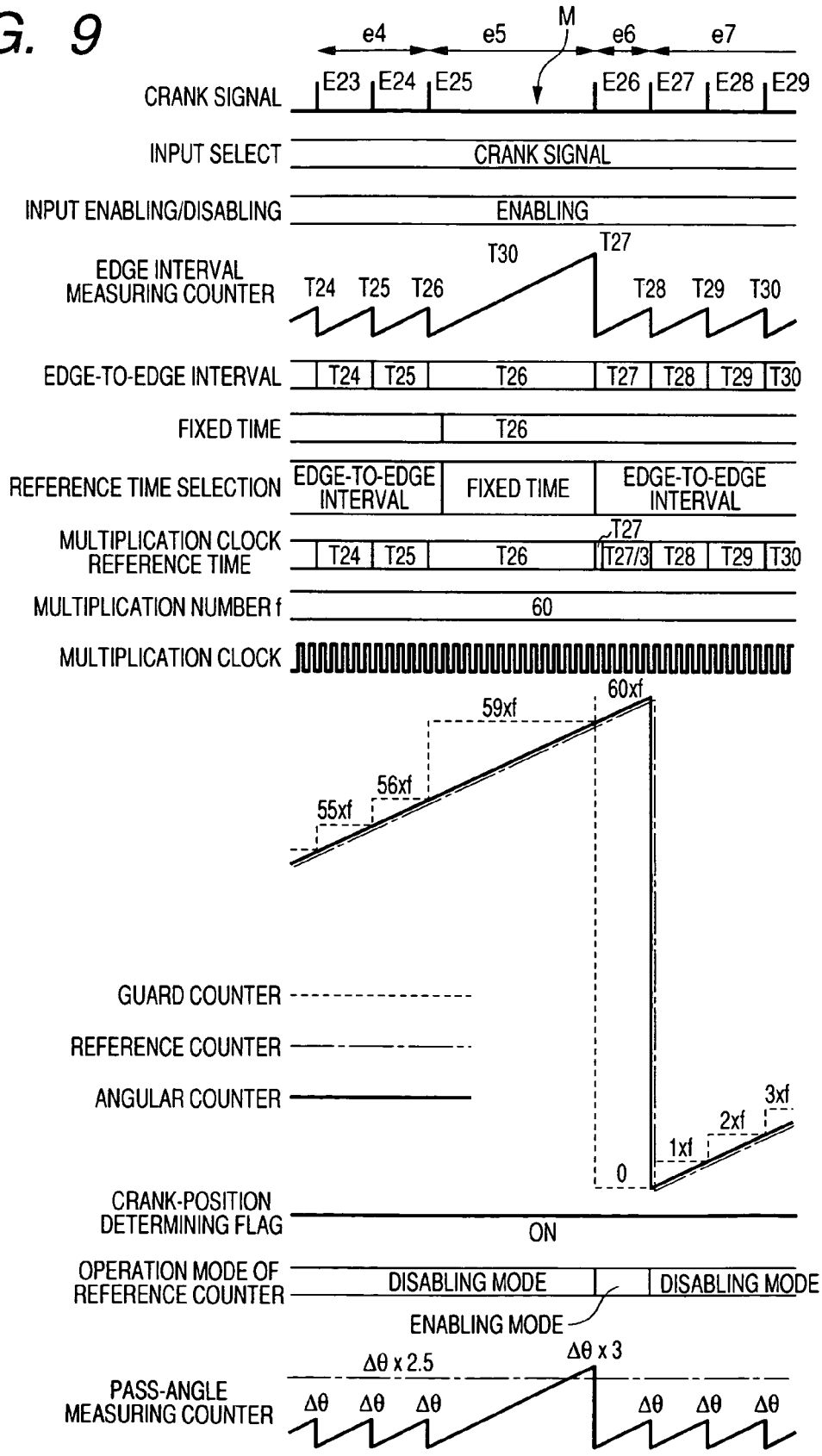
FIG. 9 is a time chart schematically illustrating variations of parameters of the angle clock generating unit with variation of the input signal during the crank-edge interrupt task illustrated in FIG. 7.

In step S360, the count value of the guard counter 260*b* is set to "0", end the reference counter 260*a* continuously counts up with the count value of the guard counter 260*b* unchanged until the count value of the reference counter 260*a* is cleared (zero) (see a section e6 in FIG. 9).

In addition, during the section e6, because the edge-to-edge interval is selected as the multiplication-clock reference time in step S372, the multiplication clock generating module 240 generates, after the operation in step S372, the multiplication clock based on the edge-to-edge interval passed from the edge interval measuring module 220 until the fixed time is selected in step S414.

Thereafter, as described above, the instructions in steps S310, S400, and S420 are repeatedly executed by the CPU 100 until it is determined that an active edge appearing in the crank signal represents the head of a pulse-missing portion M (see a section e7 in FIG. 9).

(4) Cam-Edge Interrupt Task

Fourth, instructions of a cam-edge interrupt task program will be described hereinafter with reference to FIG. 10. The instructions allow the CPU 100 to execute the cam-edge interrupt task each time an active edge appears in the cam-edge signal output from the input selecting module 210 as the input signal (see step S240 in FIG. 6) after the microcomputer 30 is booted.

When an appearance of an active edge in the cam-edge signal (input signal) triggers to launch the cam-edge interrupt task program, the CPU 100 determines whether a cam-position determining flag F2 holds information indicative of OFF in step S510. It is to be noted that the cam-position determining flag F2 is for example set by software in the microcomputer 30 each time the microcomputer 30 is booted. The information indicative of OFF is set as default information of the cam-position determining flag F2 during the microcomputer's start-up process.

If it is determined that the cam-position determining flag F2 holds the information indicative of the default of OFF (the determination in step S510 is YES), the CPU 100 determines a timing immediately after microcomputer startup, proceeding to step S520.

In step S520, the CPU 100 determines whether the count value of the guard counter 260*b* is equal to or greater than two-times the multiplication number f2, which is set to 1200 in the cam-edge interrupt task in the second register 45*b* described above. In other words, the CPU 100 determines whether the count value of the guard counter 260*b* is equal to or greater than 2400 (=2×1200). As a default, the count value of the guard counter 260*b* is set to "0".

If it is determined that the count value of the guard counter 260*b* is equal to or greater than two-times the multiplication number f2 (the determination in step S520 is YES), the CPU 100 proceeds to step S530.

In step S530, the CPU 100 sets initial values to the respective count values of the reference counter 260*a*, the guard counter 260*b*, and the angular counter 260*c* in step S530.

Specifically, in the embodiment, it is determined in advance that each active edge in the cam-edge signal corresponds to:

which of the first and second cam signals; and which of rising and trailing edges in any one of the first and second cam signals; and which of the high and low levels of the other of the first and second cam signals.

Moreover, in the embodiment, initial values to be stored in the reference counter 260*a* are determined beforehand for the respective active edges in the cam-edge signal. Similarly, initial values to be stored in the guard counter 260*b* are determined beforehand for the respective active edges in the cam-edge signal, and initial values to be stored in the angular counter 260*c* are determined beforehand for the respective active edges in the cam-edge signal.

FIG. 11 schematically illustrates correspondences between the individual initial values of the respective counters 260*a* to 260*c* and the individual active edges in the cam-edge signal in a table format.

Specifically, when an active edge appearing in the cam-edge signal corresponds to a rising edge in the first cam signal while the second cam signal is in the low level at one of the change points P, the initial values of the counters 260*a*, 260*b*, and 260*c* are respectively set to "6000", "0", and "6000".

When an active edge appearing in the cam-edge signal corresponds to a rising edge in the first cam signal while the second cam signal is in the high level at one of the change points P, the initial values of the counters 260*a*, 260*b*, and 260*c* are respectively set to "3600", "4800", and "3600".

When an active edge appearing in the cam-edge signal corresponds to a trailing edge in the first cam signal while the second cam signal is in the low level at one of the change points Q, the initial values of the counters 260*a*, 260*b*, and 260*c* are respectively set to "5700", "6900", and "5700".

When an active edge appearing in the cam-edge signal corresponds to a trailing edge in the first cam signal while the second cam signal is in the high level at one of the change points P, the initial values of the counters 260*a*, 260*b*, and 260*c* are respectively set to "1200", "2400", and "1200".

In addition, when an active edge appearing in the cam-edge signal corresponds to a rising edge in the second cam signal while the first cam signal is in the low level at one of the change points P, the initial values of the counters 260*a*, 260*b*, and 260*c* are respectively set to "2400", "3600", and "2400".

When an active edge appearing in the cam-edge signal corresponds to a rising edge in the second cam signal while the first cam signal is in the high level at one of the change points P, the initial values of the counters 260*a*, 260*b*, and 260*c* are respectively set to "0", "1200", and "0".

When an active edge appearing in the cam-edge signal corresponds to a trailing edge in the second cam signal while the first cam signal is in the low level at one of the change points Q, the initial values of the counters 260*a*, 260*b*, and 260*c* are respectively set to "2100", "3300", and "2100".

When an active edge appearing in the cam-edge signal corresponds to a trailing edge in the second cam signal while the first cam signal is in the high level at one of the change points P, the initial values of the counters 260*a*, 260*b*, and 260*c* are respectively set to "4800", "6000", and "4800".

Figure 12:
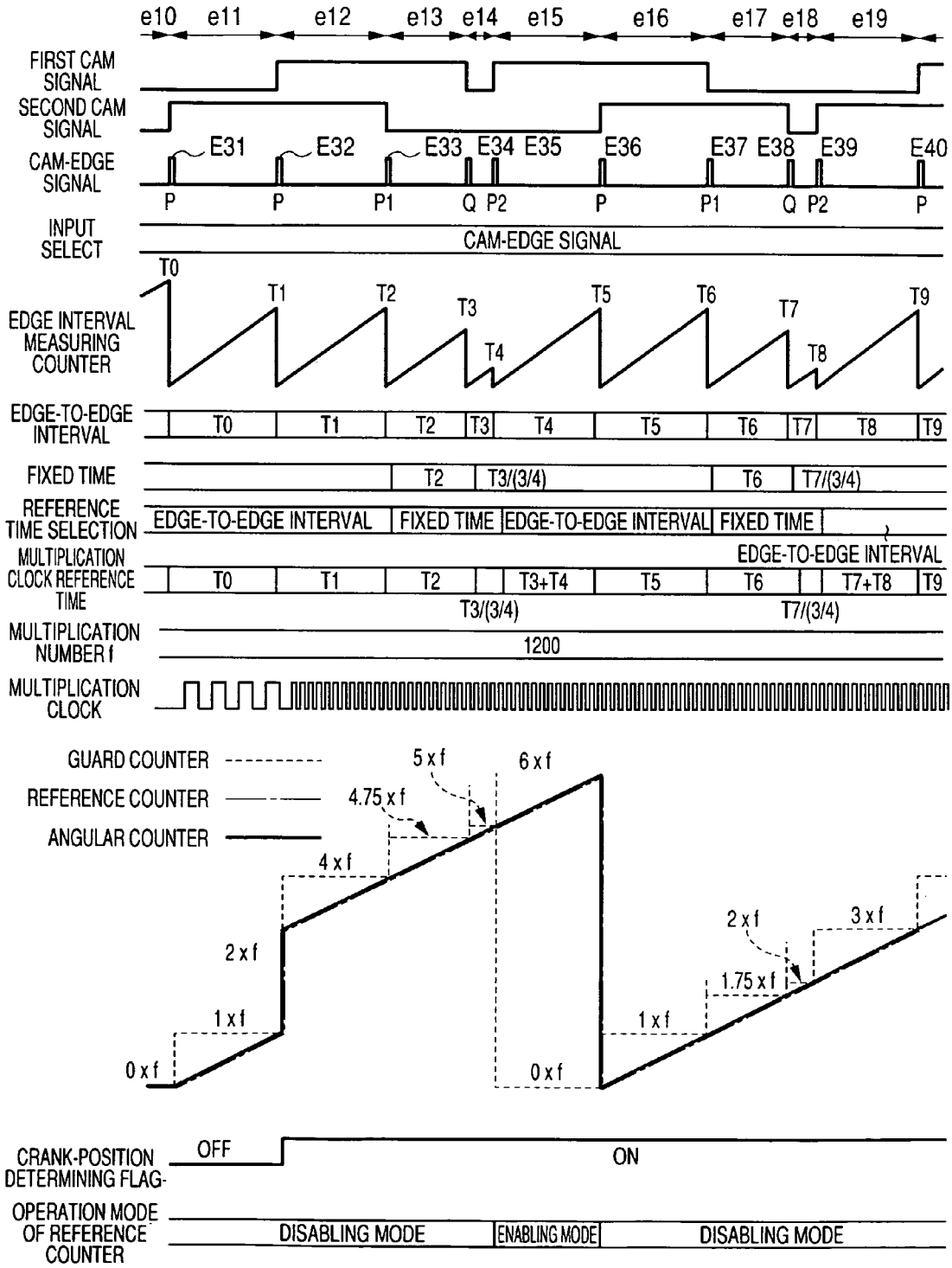
FIG. 12 is a time chart schematically illustrating variations of parameters of the angle clock generating unit with variation of the input signal during the cam-edge interrupt task illustrated in FIG. 11.

It is to be noted that "rising edge" and "trailing edge" are respectively represented by the mark "↑" and the mark "↓" in FIG. 12, and that "low level" and "high level" are respectively represented by the characters "L" and "H" in FIG. 11.

In the embodiment, for example, data indicative of the correspondences between the individual initial values of the respective counters 260*a* to 260*c* and the individual active edges in the cam-edge signal are stored in advance in a table TA. Moreover, the table TA is for example stored beforehand in the flash ROM 400.

Specifically, in step S530, the CPU 100 references the data in the table TA to read out initial values for the respective counters 260*a* to 260*c*; these readout initial values correspond to a current active edge appearing in the cam-edge signal. Then, the CPU 100 stores the readout initial values in the corresponding counters 260*a* to 260*c*, respectively in step S530.

Thereafter, the CPU 100 changes the information held by the cam-position determining flag F2 from OFF to ON in step S540, proceeding to step S570.

Otherwise if it is determined that the count value of the guard counter 260*b* is smaller than two-times the multiplication number f2 (the determination in step S520 is NO), the CPU 100 proceeds to step S570 while skipping the instructions in steps S550 and S560.

Otherwise if it is determined that the cam-position determining flag F2 holds the information indicative of ON (the determination in step S510 is NO), the CPU 100 shifts to step S550.

In step S550, the CPU 100 determines whether the count value of the guard counter 260*b* is equal to or greater than the product of the multiplication number f2 (1200) and the number of cylinders, which is 6 in the embodiment. In other words, the CPU 100 determines whether the count value of the guard counter 260*b* is equal to or greater than 7200 (=6×1200).

If it is determined that the count value of the guard counter 260*b* is equal to or greater than the product of the multiplication number f2 (1200) and the number (6) of cylinders (the determination in step S550 is YES), the CPU 100 goes to step S560. In step S560, the CPU 100 sets "0" to the count value of the guard counter 260*b*, proceeding to step S570.

Otherwise if it is determined that the count value of the guard counter 260*b* is smaller than the product of the multiplication number f2 (1200) and the number (6) of cylinders (the determination in step S550 is NO), the CPU 100 goes to step S570 while skipping the instruction in step S560.

In step S570, the CPU 100 checks whether the count value of the guard counter 260*b* is "0".

If it is determined that the count value of the guard counter 260*b* is set to "0" (the determination in step S570 is YES), the CPU 100 sends, to the angle clock module 260, an instruction indicative of the enabling mode in step S580 similar to step S370. This allows the reference counter 260*a* to count in the enabling mode described above even if "0" is set to the count value of the guard counter 260*b*.

Otherwise if it is determined that the count value of the guard counter 260*b* is different from "0" (the determination in step S570 is NO), the CPU 100 sends, to the angle clock module 260, an instruction indicative of the disabling mode in step S590 similar to step S420. This permits the reference counter 260*a* to count in the disabling mode described above.

After the establishment of the operating mode of the reference counter 260*a* in step S580 or S590, the CPU 100 goes to step S600.

The CPU 100 checks whether the trigger active edge for the cam-edge interrupt task consists of an irregular region of the cam-edge signal in step S600. In other words, the CPU 100 determines whether the trigger active edge for the cam-edge interrupt task represents a change point Q or a change point located before or after a change point Q in step S600 (S610, S620, and S630).

In the embodiment, as illustrated in FIGS. 2, 11, and 12, the change points Q is a point at which the level of any one of the first cam signal and second cam signal transiently changes in the high-to-low direction while the other thereof is in the low level.

Thus, a change point P1 at which the level of any one of the first cam signal and second cam signal transiently changes in the high-to-low direction while the other thereof is in the high level is a change point immediately before a change point Q.

A change point P2 at which the level of any one of the first cam signal and second cam signal transiently changes in the low-to-high direction while the other thereof is in the low level is a change point immediately after a change point Q.

For example, in step S600, the CPU 100 references the data of the table TA to determine whether the trigger active edge for the cam-edge interrupt task consists of an irregular region of the cam-edge signal based on the result of the reference.

If it is determined that the trigger active edge represents a change point P1 at which the level of any one of the first cam signal and second cam signal transiently changes in the high-to-low direction while the other thereof is in the high level (the determination in step S610 is YES), the CPU 100 goes to step S612.

In step S612, like step S412, the CPU 100 sends, to the reference time selecting module 230, an instruction to store, in the register 230*a*, the edge-to-edge interval as the fixed time; this edge-to-edge interval is passed from the edge interval measuring module 220 in response to the trigger active edge for the cam-edge interrupt task.

When receiving the instruction, the reference time selecting module 230 stores, in the register 230*a*, the edge-to-edge interval as the fixed time.

Next, like step S414, the CPU 100 sends, to the reference time selecting module 230, an instruction to select, as the multiplication-clock reference time, the fixed time in step S614.

When receiving the instruction, the reference time selecting module 230 transfers, to the multiplication clock generating module 240, the fixed time stored in the register 230*a* until an instruction to select, as the multiplication-clock reference time, the edge-to-edge interval is passed thereto from the CPU 100.

Thereafter, in step S616, the CPU 100 sets, to the count value of the guard counter 260*b*, a check-result value based on the determination in steps S600 and S610. Thereafter, the CPU 100 exits the cam-edge interrupt task.

For example, when it is determined that the trigger active edge represents a change point P1 at which the level of the second cam signal transiently changes in the high-to-low direction while the first cam signal is in the high level, the product of "4.75" and the multiplication number f2, which can be expressed by "{(4+¾)×f2}", is set to the count value of the guard counter 260*b* as the check-result value based on the determination in steps S600 and S610.

In contrast, when it is determined that the trigger active edge represents a change point P1 at which the level of the first cam signal transiently changes in the high-to-low direction while the second cam signal is in the high level, the product of "1.75" and the multiplication number f2, which can be expressed by "{(1+¾)×f2}" is set to the count value of the guard counter 260*b* as the check-result value based on the determination in steps S600 and S610.

Otherwise when the trigger active edge represents a change point Q at which the level of any one of the first cam signal and second cam signal transiently changes in the high-to-low direction while the other thereof is in the low level (the determination in step S610 is NO and that in step S620 is YES), the CPU 100 goes to step S622.

In step S622, the CPU 100 sends, to the reference time selecting module 230, an instruction to store, as the fixed time, a value in the register 230*a*. The value to be stored in the register 230*a* is obtained by correcting, based on a timing of a corresponding change point Q in the corresponding irregular region of the cam-edge signal, the edge-to-edge interval passed from the edge interval measuring module 220 in response to the trigger active edge for the cam-edge interrupt task.

When receiving the instruction, the reference time selecting module 230 divides the edge-to-edge interval passed from the edge interval measuring module 220 in response to the trigger active edge for the cam-edge interrupt task by the ratio of a time interval between temporally adjacent change points P and Q to that between temporally adjacent change points P. In the embodiment, the ratio is obtained as "¾". The reference time selecting module 230 stores, in the register 230*a*, the obtained division as the fixed time.

Next, like step S414, the CPU 100 sends, to the reference time selecting module 230, an instruction to select, as the multiplication-clock reference time, the fixed time in step S624.

When receiving the instruction, the reference time selecting module 230 transfers, to the multiplication clock generating module 240, the fixed time stored in the register 230*a* until an instruction to select, as the multiplication-clock reference time, the edge-to-edge interval is passed thereto from the CPU 100.

Thereafter, in step S626, the CPU 100 sets, to the count value of the guard counter 260*b*, a check-result value based on the determination in steps S600 and S620. Thereafter, the CPU 100 exits the cam-edge interrupt task.

For example, it is assumed that the trigger active edge represents a change point Q at which the level of the first cam signal transiently changes in the high-to-low direction while the second cam signal is in the low level. In this assumption, the product of "5" and the multiplication number f is set to the count value of the guard counter 260*b* as the check-result value based on the determinations in steps S600 and S620.

In contrast, it is assumed that the trigger active edge represents a change point Q at which the level of the second cam signal transiently changes in the high-to-low direction while the first cam signal is in the low level. In this assumption, the product of "2" and the multiplication number f2 is set to the count value of the guard counter 260*b* as the check-result value based on the determinations in steps S600 and S620.

Otherwise when the trigger active edge represents a change point P2 immediately after a change point Q (the determination in step S620 is NO and that in step S630 is YES), the CPU 100 goes to step S632.

In step S632, the CPU 100 sends, to the reference time selecting module 230, an instruction to correct the multiplication-clock reference time to be stored in the register 230*a*.

When receiving the instruction, the reference time selecting module 230 computes the sum of a previously passed edge-to-edge interval from the module 220 and an edge-to-edge interval passed therefrom next to the previously passed edge-to-edge interval, thus storing the computed value in the register 230*a* as the multiplication-clock reference time.

Next, like step S372, the CPU 100 sends, to the reference time selecting module 230, an instruction to select, as the multiplication-clock reference time, the edge-to-edge interval in step S634, and thereafter exits the cam-edge interrupt task.

When receiving the instruction, the reference time selecting module 230 transfers, to the multiplication clock generating module 240, the edge-to-edge interval until an instruction to select, as the multiplication-clock reference time, the fixed time is passed thereto from the CPU 100.

Otherwise when the trigger active edge represents a change point except for a change point Q and a change point located before or after a change point Q (determination in step S630 is NO), the CPU 100 exits the cam-edge interrupt task while skipping the instructions in steps S612 to S632.

Next, specific operations of the respective modules 210, 220, 230, is 240, 250, and 260 under control of the CPU 100 in the cam-edge interrupt task and variations of the parameters, such as the count values of the counters 220*a*, 260*a*, 260*b*, and 260*c*, will be described hereinafter with reference to FIGS. 10 and 12.

When the cam-edge interrupt program is launched first in response to a trigger active edge in the cam-edge signal (see E31 in FIG. 12), the cam-position determining flag holds the information indicative of the default of OFF and the count value of the guard counter 260*b* is incremented by 1×f from the default of "0" (see sections e10 and e11 in FIG. 12). For this reason, the determination in S510 is affirmative and the determination in step S520 is negative, so that execution of the CPU 100 is shifted to the instruction in step S570.

Because the count value of the guard counter 260*b* is set to "1×f", which is not to "0", the determination in step S570 is NO, so that execution of the CPU 100 goes to the instruction in step S600 via that in step S590.

At that time, because an active edge E31 in the cam-edge signal represents a change point P at which the level of the second cam signal transiently changes in the low-to-high direction while the first cam-edge signal is in the low level, the determinations in steps S610 to S630 are all negative, then the cam-edge interrupt task is terminated.

Thereafter, when the next active edge appears in the cam-edge signal (see E32 in FIG. 12), the cam-position determining flag F2 holds the information indicative of the default of OFF and the count value of the guard counter 260*b* is incremented by 1×f from the count value "1×f" so as to become "2×f" (see sections e12 in FIG. 12). This allows the determination in step S520 to be affirmative.

After the affirmative determination in step S520, the initial values, which are determined based on the current active edge (E32) in the cam-edge signal and the table TA, are stored in the corresponding counters 260*a*, 260*b*, and 260*c*, respectively in step S530. Specifically, the initial values of 3600 equivalent to "3×f", 4800 equivalent to "4×f", and 3600 equivalent to "3×f" are stored, as their count values, in the reference counter 260*a*, the guard counter 260*b*, and the angular counter 260*c*, respectively (see the table TA in FIG. 11).

After the execution of the instruction in step S530, the cam-position determining flag F2 is set to the information indicative of ON in step S540.

Next, after the operations in step S570, S590, and S600, because the active edge E32 in the cam-edge signal does not represent a change point P1 immediately before a change point Q, the determinations in steps S610 to S630 are all negative, then the cam-edge interrupt task is terminated.

Thereafter, the operations in step S510 to S630 are repeated until the determination in step S610 is affirmative.

Specifically, when the next active edge E33 whose next active edge corresponds to a change point Q appears in the cam-edge signal (see FIG. 12), the determination in step S610 is affirmative.

This permits the edge-to-edge interval to be stored in the register 230*a* as the fixed time (see step S612), and the fixed time is selected as the multiplication-clock reference time (see step S614). Thereafter, the product of "4.75" and the multiplication number f2 is set to the count value of the guard counter 260*b* as the check-result value based on the determination in steps S600 and S610 (see a section e13 in FIG. 12), and thereafter, the cam-edge interrupt task is terminated.

Because the fixed time is selected as the multiplication-clock reference time in step S614, the multiplication clock generating module 240 generates, after the operation in step S614, the multiplication clock based on the fixed time until the edge-to-edge interval is selected in step S634.

When the next active edge E34 appears in the cam-edge signal (see FIG. 12), because the active edge E34 represents a change point Q, the determination in step S620 is affirmative.

This permits the value obtained by correcting the edge-to-edge interval to be stored in the register 230*a* as the fixed time; this value is represented by the division of the edge-to-edge interval by the ratio (¾).

Thereafter, the fixed time is selected as the multiplication-clock reference time (see step S624). Thereafter, the product of "5" and the multiplication number f2 is set to the count value of the guard counter 260*b* as the check-result value based on the determination in steps S600 and S610 (see the section e14 in FIG. 12), and thereafter, the cam-edge interrupt task is terminated.

When the next active edge E35 appears in the cam-edge signal (see FIG. 12), because the active edge E35 represents a change point P2 immediately after the change point Q, the determination in step S630 is affirmative.

In step S632, the multiplication-clock reference time is corrected (see "T3+T4" in FIG. 12), and the edge-to-edge interval is selected as the multiplication-clock reference time in step S634 (see a section e15). Thereafter, the cam-edge interrupt task is terminated.

Because the edge-to-edge interval is selected as the multiplication-clock reference time in step S634, the multiplication clock generating module 240 generates, after the operation in step S634, the multiplication clock based on the edge-to-edge interval until the fixed time is selected in step S614 or S624.

Thereafter, each time an active edge appears in the cam-edge signal, the operations in steps S510 to S634 are executed.

As a result, when the count value of the guard counter 260*b* has been increased to reach "7200", which is equal to the product of the multiplication number f2 (1200) and the number of cylinders, which is 6 in the embodiment, the determination in step S550 is YES. Thus, "0", is set to the count value of the guard counter 260*b* in step S560.

Thus, the determination in step S570 is YES, so that the reference counter 260*a* executes the count-up operation in the enabling mode in step S580.

Even if the count value of the guard counter 260*b* is set to "0" in step 560, the operating mode of the reference counter 260*a* is set to the enabling mode in step S580, For this reason, the reference counter 260*a* continuously counts up until the count value reaches the upper limit stored in the first register 260*d* (see a section e15 in FIG. 12).

Thereafter, when the count value of each of the reference counter 260*a* and the angular counter 260*c* reaches the upper limit "7200 (6×f)" stored in the first register 260*d* with the count value of the guard counter 260*b* remaining "0" at the appearance of an active edge E36 in the cam-edge signal (see FIG. 12), the count values of the reference counter 260*a* and the angular counter 260*c* are cleared (zero) (see the section e15 in FIG. 12).

Thereafter, as described above, the instructions in steps S550, S570, S590, S600, S610, S620, and S630 are repeatedly executed by the CPU 100 each time an active edge appears in the cam-edge signal. The repeated executions of the instructions in steps S550, S570, S590, S600, S610, S620, and S630 are executed until it is determined that the count value of the guard counter 260*b* has been increased to reach the product of the multiplication number f2 (1200) and the number (6) of cylinders in step S550.

As described above, the ECU 1 according to the embodiment is configured to generate the angle clock based on the crank signal or the cam-edge signal, and control at least one of the actuators associated with control of the engine based on a rotational position of the crankshaft CS specified by the count value of the angle clock.

Figure 7:
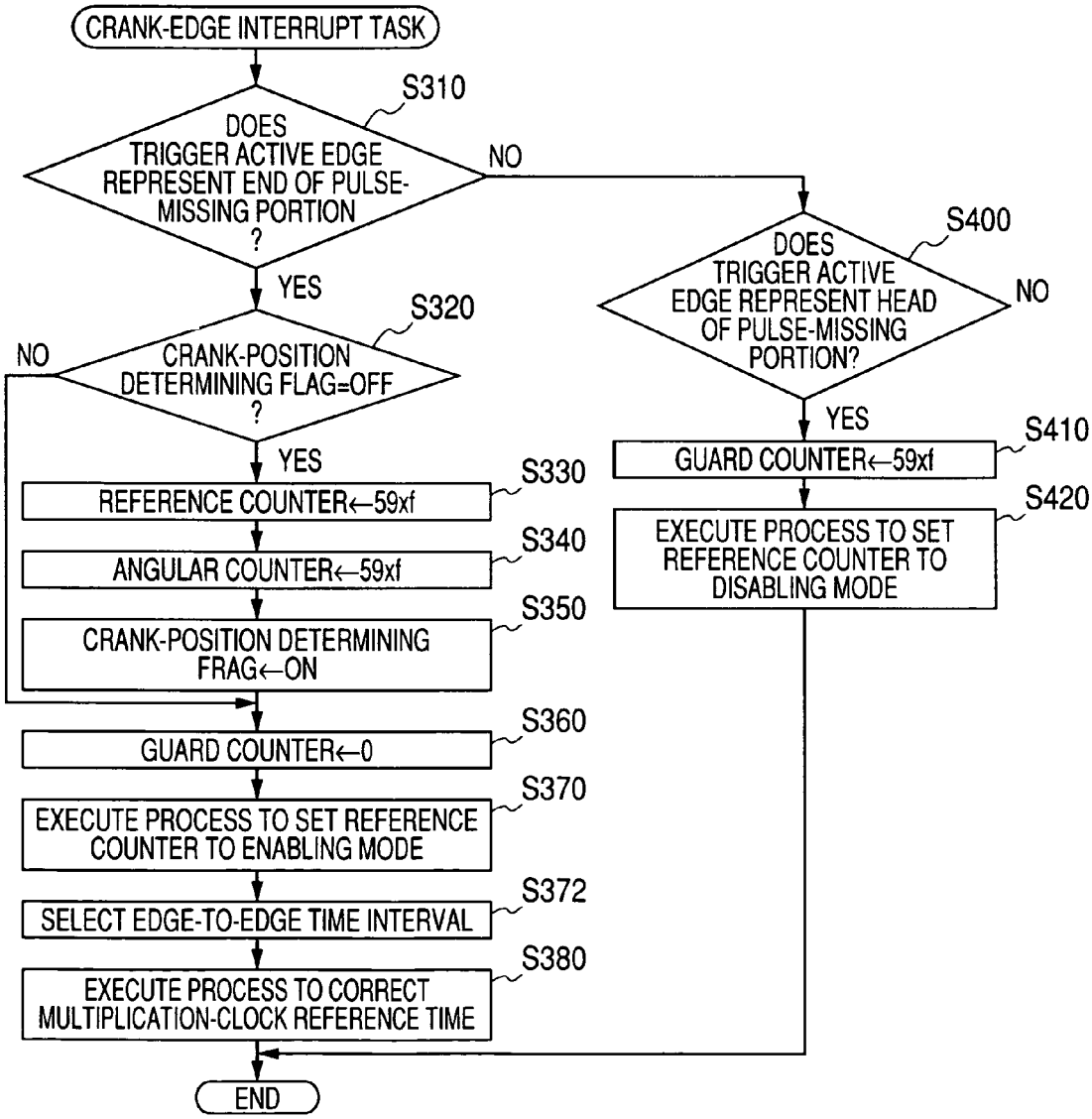
FIG. 7 is a flowchart schematically illustrating a crank-edge interrupt task to be executed by the CPU illustrated in FIG. 1.

In the configuration of the ECU 1, after a trigger active edge representing the head of an irregular region of the crank signal or cam-edge signal (see YES in step S400 of FIG. 7 or in step S610 of FIG. 10), the multiplication-clock reference time on which the multiplication clock is based is secured to the fixed time (see the operations in steps S414 of FIG. 7 and S614 of FIG. 10). Thus, the angle clock is generated based on the fixed time as the multiplication-clock reference time.

Specifically, after an irregular region has been started in the crank signal or cam-edge signal (see YES in step S400 of FIG. 7 or in step S610 of FIG. 10), the angle clock is generated based on the fixed time as the multiplication-clock reference time until the irregular region is terminated so that the edge-to-edge interval is set as the multiplication-clock reference time.

In other words, after an irregular region has been started in the crank signal or cam-edge signal until it is terminated so that the edge-to-edge interval is set as the multiplication-clock reference time, even if an abnormal edge-to-edge interval passed from the module 220 is different from a normal edge-to-edge interval passed therefrom in a regular region of the crank signal or cam-edge signal, it is possible to prevent angle clocks from being generated based on the abnormal edge-to-edge interval.

For this reason, setting the fixed time to a suitable value estimated at the end of an irregular region of the crank signal or the cam-edge signal allows a proper angle clock to be generated based on the suitable value even within a period from the end of the irregular region to change of the multiplication-clock reference time to the edge-to-edge interval.

The angle clock generated based on the suitable value estimated at the end of an irregular region of the crank signal or the cam-edge signal can prevent an active edge of the angle clock from being delayed from a corresponding actual crank position of the crankshaft CS. This makes it possible to properly identify the operating conditions of the engine based on the count value of the angle clock, thus improving the accuracy of control of the engine.

In the embodiment, as the fixed time selected in step S414 of FIG. 7, in step S614 of FIG. 10, or step S634 thereof, the edge-to-edge interval passed from the edge interval measuring module 220 in response to the appearance of the trigger active edge for the crank-edge interrupt task or the cam-edge interrupt task is set. In other words, as the fixed time selected in step S414 of FIG. 7, in step S614 of FIG. 10, or step S634 thereof, the edge-to-edge interval measured by the edge interval measuring module 220 at the head of an irregular region of the crank signal or cam-edge signal is set.

The edge-to-edge interval measured by the edge interval measuring module 220 at the head of an irregular region of the crank signal or cam-edge signal represents appearance of a predetermined-directed level change in a part of the regular region of the crank signal or cam-edge signal; this part is located immediately before the corresponding irregular region. Specifically, the edge-to-edge interval measured by the edge interval measuring module 220 at the head of an irregular region of the crank signal or cam-edge signal is closer than any other edge-to-edge intervals measured before then. This results that the edge-to-edge interval measured by the edge interval measuring module 220 at the head of an irregular region reflects the level change in the irregular region of the crank signal or the cam-edge signal.

For this reason, setting, as the fixed time selected in step S414 of FIG. 7, in step S614 of FIG. 10, or step S634 thereof, the edge-to-edge interval measured by the edge interval measuring module 220 at the head of an irregular region of the crank signal or cam-edge signal allows an angle clock on which the level change in the irregular region of the crank signal or the cam-edge signal to be generated based on the fixed time.

In the embodiment, when the edge-to-edge interval passed from the edge interval measuring module 220 in response to the end of an irregular region of the crank signal or the cam-edge signal is set as the multiplication-clock reference time (see step S372 of FIG. 7 or step S634 of FIG. 10), the multiplication-clock reference time (edge-to-edge interval) is corrected based on the period in the corresponding irregular region (see step S380 of FIG. 7 or step S634 of FIG. 10).

Specifically, immediately after the edge-to-edge interval passed from the edge interval measuring module 220 is set as the multiplication-clock reference time when an active edge representing the end of an irregular region of the crank signal or the cam-edge signal appears, the multiplication clock generating module 240 works to generate an angle clock based on the edge-to-edge interval within the irregular region.

Because the edge-to-edge interval within the irregular region represents a time interval between temporally adjacent active edges in the irregular region of the crank signal or the cam-edge signal, it may be different from an edge-to-edge interval within a regular region of the crank signal or the cam-edge signal.

In this case, immediately after the multiplication-clock reference time is reset to the edge-to-edge interval, it is assumed that the multiplication clock generating module 240 divides the multiplication-clock reference time by the multiplication number f to generate a multiplication clock (angle clock) whose clock cycle is a multiplication-number submultiple of the multiplication-clock reference time.

In this assumption, the clock cycle of the generated angle clock is different from that of an angle clock generated in a regular region of the crank signal or the cam-edge signal.

This is because an edge-to-edge interval measured in the regular region of the crank signal or the cam-edge signal is different from that measured in the irregular region thereof even if the crankshaft CS is rotated corresponding to the irregular region as in the case of corresponding to the regular region.

This may cause the count of an angle clock generated in the irregular region to be delayed from that of an angle clock generated in the regular region of the crank signal or the cam-edge signal. This may result that a crank position of the crankshaft CS corresponding to the count value of an active edge of the angle clock generated in the irregular region is different from a corresponding actual crank position of the crankshaft CS.

However, in the embodiment, immediately after the multiplication-clock reference time is reset to the edge-to-edge interval, the multiplication clock generating module 240 corrects the edge-to-edge interval passed from the module 220 based on an interval of the corresponding irregular region without directing using the edge-to-edge interval. After the correction, the multiplication clock generating module 240 divides the corrected edge-to-edge interval (multiplication-clock reference time) by the multiplication number f to generate a multiplication clock (angle clock) whose clock cycle is a multiplication-number submultiple of the corrected multiplication-clock reference time.

Counting the angle clock whose clock cycle is a multiplication-number submultiple of the corrected multiplication-clock reference time can prevent the count of the angle clock from being delayed from the count of an angle clock generated in a regular region of the crank signal or the cam-edge signal. This makes it possible to reduce the difference between a crank position of the crankshaft CS corresponding to the count value of an active edge of the angle clock generated in the irregular region and a corresponding actual crank position of the crankshaft CS.

In the embodiment, in step S380 of FIG. 7, an edge-to-edge interval measured in an irregular region of the crank signal is corrected to a value obtained by:

calculating the product of the measured edge-to-edge interval and a ratio of a period between temporally adjacent active edges in a regular region of the crank signal to a time interval temporally adjacent active edges in the irregular region thereof. For example, in the embodiment, the ratio is set to "⅓". Thereafter, the corrected edge-to-edge interval is stored in the first register 240*a* as the corrected multiplication-clock reference time.

The product of an edge-to-edge interval measured in an irregular region of the crank signal and a ratio of a period between temporally adjacent active edges in a regular region thereof to a period temporally adjacent active edges in the irregular region represents an edge-to-edge interval to be measured in the regular region.

The edge-to-edge interval to be measured in the regular region satisfies that:

the ratio of the edge-to-edge interval measured in the irregular region to the edge-to-edge interval measured in the regular region is equal to the ratio of the period between temporally adjacent active edges in the irregular region to the period between temporally adjacent active edges in the regular region.

Specifically, the edge-to-edge interval to be measured in the regular region corresponds to an edge-to-edge interval continuously measured in the irregular region only for a period temporally adjacent active edges in the regular region.

For this reason, the correction of an edge-to-edge interval measured in an irregular region of the crank signal allows the corrected edge-to-edge interval to be approximated to an edge-to-edge interval to be measured in a regular region of the crank signal.

Figure 6:
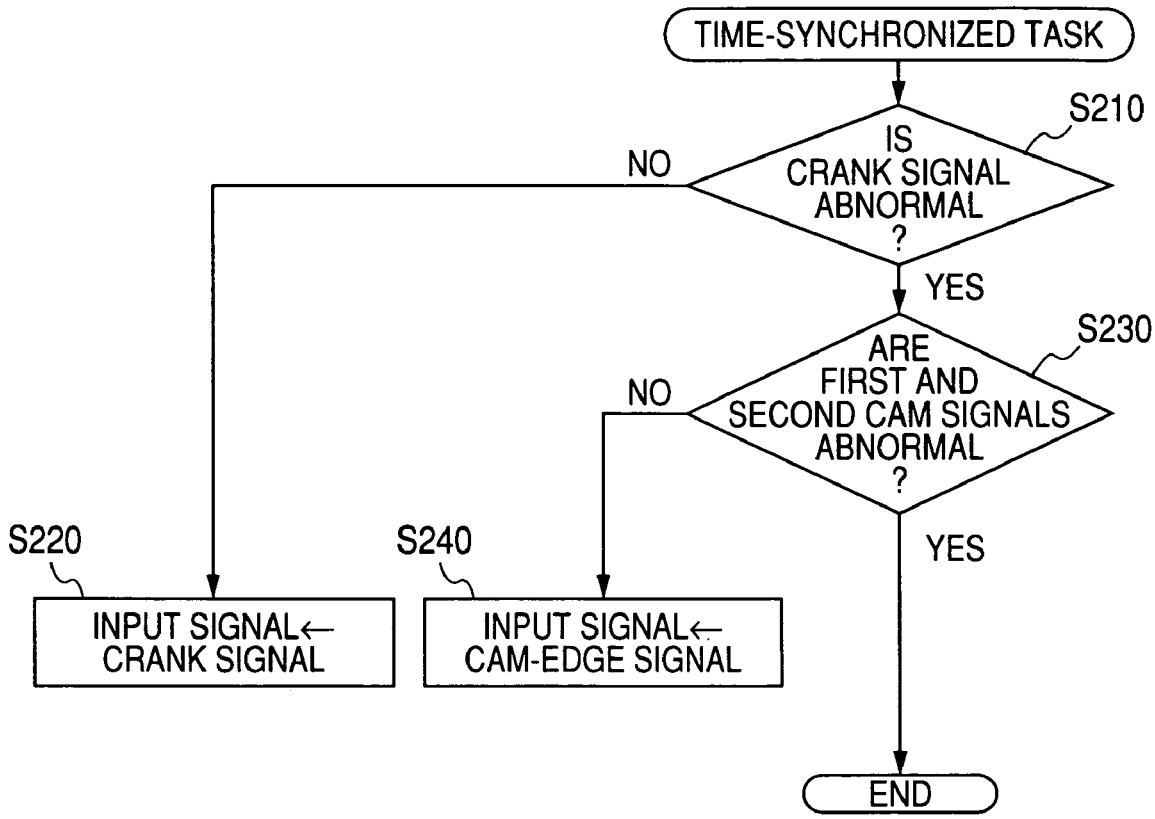
FIG. 6 is a flowchart schematically illustrating a time-synchronized task to be executed by the CPU illustrated in FIG. 1.

In the embodiment, when detecting that the crank signal is abnormal, the ECU 1 is configured to:

change the input signal to be used by the modules in the angle clock generating unit 200 from the crank signal to the cam-edge signal; and change the multiplication number f from the number f1 (60) for the crank signal to the number f2 (1200) for the cam-edge signal (see step S240 in FIG. 6).

This permits a period measured by the edge interval measuring counter 220*a* to be changed from a value corresponding to a rotational angle (regular angle) of the crankshaft CS required to generate temporally adjacent active edges in the crank signal (the unit angle Δθ of 6 degrees crank angle referred to as "first regular angle" hereinafter) to that corresponding to a rotational angle (regular angle) of each cam shaft required to generate temporally adjacent active edges in the cam-edge signal (120 degrees crank angle referred to as "second regular angle" hereinafter).

Similarly, a clock cycle of a multiplication clock generated by the multiplication clock generating module 240 is changed from a value obtained by dividing, by the multiplication number f1 (60) for the crank signal, the multiplication-clock time based on the first regular angle to a value obtained by dividing, by the multiplication number f2 (1200) for the cam-edge signal, the multiplication-clock time corresponding to the second regular angle.

It is to be noted that the multiplication number f2 for the cam-edge signal is obtained by:

calculating the product of the second regular angle for the first and second camshafts CM1 and CM2 and the first multiplication number f1 for the crank signal; and dividing the obtained product by the first regular angle.

That is, the multiplication number f2 for the cam-edge signal is determined to be "(120×60)/6=1200".

In other words, the relationship between the multiplication number f1 for the crank signal and the multiplication number f2 for the cam-edge signal is given by the following equation:

$$\frac{\alpha 1}{f1} = \frac{\alpha 2}{f2} \quad \text{[Equation 1]}$$

where α1 is the first regular angle, and α2 is the second regular angle.

Specifically, the multiplication number f2 for the cam-edge signal is obtained to meet the equation 1.

In other words, in the embodiment, even though the input signal is changed from the crank signal to the cam-edge signal and the multiplication number is changed from the multiplication number f1 (60) for the crank signal to the multiplication number f2 (1200) for the cam-edge signal, the ratio of the multiplication number f1(60) for the crank signal to the first regular angle is matched with that of the multiplication number f2 (1200) for the cam-edge signal to the second regular angle.

Specifically, the clock cycle of the multiplication clock generated by the multiplication clock generating module 240 is constant although the multiplication number f is changed from the number f1 for the crank signal to the number f2 for the cam-edge signal and the period is changed from a value corresponding to the first regular angle to that corresponding to the second regular angle. This is because the ratio of the multiplication number f1(60) for the crank signal to the first regular angle is matched with that of the multiplication number f2 (1200) for the cam-edge signal to the second regular angle.

In other words, change of the multiplication number f from the number f1 for the crank signal to the number f2 for the cam-edge signal allows the clock cycle of the multiplication clock generated by the multiplication clock generating module 250 to be constant.

Specifically, the clock cycle of the multiplication clock to be used to operate the reference counter 260*a* and the angular counter 260*c* of the angle clock module 260 is kept constant before and after change of the input signal and the multiplication number f. This makes it unnecessary for the angle clock module 260 to execute specific tasks for switching its operations before and after change of the input signal and the multiplication number f.

This allows the ECU 1 to just change the input signal and the multiplication number to thereby continue engine control based on the cam-edge signal even when a failure occurs in the crank signal. This makes it unnecessary for the multiplication clock generating module 240, the angle clock module 260, and the timer output unit 300 to execute specific tasks for switching their operations after change of the input signal and the multiplication number f.

Thus, if the crank signal cannot be input normally to the ECU 1 due to, for example, a break in wires connecting the crankshaft sensor 11 and the ECU 1, the ECU 1 cannot identify the rotational position of the crankshaft CS.

In this case, in the embodiment, it is possible for the ECU 1 to continuously carry out proper control of the engine based on the cam-edge signal in place of the crank signal.

In the embodiment, when a change point Q appears in an irregular region of the cam-edge signal (see YES in step S620 of FIG. 10), the multiplication-clock reference time to be referenced when the multiplication clock is generated is secured to the fixed value obtained by:

dividing the edge-to-edge interval passed from the edge interval measuring module 220 in response to the trigger active edge for the cam-edge interrupt task by a value based on a timing of the corresponding change point Q in the corresponding irregular region (see step S622 in FIG. 10).

It is to be noted that the "value based on the timing of the corresponding change point Q" is a ratio of a period in the irregular region between the trigger active edge for the cam-edge interrupt task and occurrence of a level change in the cam-edge signal to a period in a regular region of the cam-edge signal.

Specifically, the division of the edge-to-edge interval passed from the module 220 by the ratio represents an edge-to-edge interval to be measured in the regular region.

The edge-to-edge interval to be measured in the regular region satisfies that:

the ratio of the edge-to-edge interval in the irregular region between the trigger active edge and occurrence of a level change in the cam-edge signal to an edge-to-edge interval of a regular region thereof is equal to the ratio of the period in the irregular region between the trigger active edge and occurrence of a level change in the cam-edge signal to a period in the regular region thereof.

Specifically, the edge-to-edge interval to be measured in the regular region corresponds to an edge-to-edge interval continuously measured in the irregular region only for a period temporally adjacent active edges in the regular region.

For this reason, the correction of an edge-to-edge interval measured in an irregular region of the crank signal allows the corrected edge-to-edge interval to be approximated to an edge-to-edge interval to be measured in a regular region of the cam-edge signal.

After the correction, the multiplication clock generating module 240 divides the corrected edge-to-edge interval (multiplication-clock reference time) by the multiplication number f to generate a multiplication clock (angle clock) whose clock cycle is a multiplication-number submultiple of the corrected multiplication-clock reference time.

Counting the angle clock whose clock cycle is a multiplication-number submultiple of the corrected multiplication-clock reference time can prevent the count of the angle clock from being delayed from the count of an angle clock generated in a regular region of the cam-edge signal. This makes it possible to reduce the difference between a crank position of the crankshaft CS corresponding to the count value of an active edge of the angle clock generated in the irregular region and a corresponding actual crank position of the crankshaft CS.

In step S310 of FIG. 7, when the interrupt output from the pass-angle measuring module 250 is received, it is possible for the CPU 100 to determine that the trigger active edge represents the end of an irregular region of the crank signal or the cam-edge signal.

In step S400 of FIG. 7, it is possible to determine that a trigger active edge for the crank-edge or cam-edge interrupt task represents the head of an irregular region of the crank signal or cam-edge signal based on the count value of the angular counter 260*c*.

Modifications

In the embodiment, as the fixed time selected in steps S414, S614 and S634, the edge-to-edge interval passed from the module 220 in response to the trigger active edge for the crank-edge or cam-edge interrupt task is stored in the register 230*a*, but the present invention is not limited to the structure.

Specifically, as the fixed time selected in steps S414, S614, and S634, a suitable value experimentally or logically estimated at the end of an irregular region of the crank signal or the cam-edge signal can be used.

In the embodiment, the ECU 1 is configured to control the engine based on the crank signal when the crank signal is normal. The ECU 1 can be configured to control the engine based on another signal consisting of at least one regular region and at least one irregular region.

In the embodiment, in step S310 of FIG. 7, when the interrupt output from the pass-angle measuring module 250 is received, the CPU 100 determines that the trigger active edge represents the end of an irregular region of the crank signal or the cam-edge signal. However, the present invention is not limited to the structure.

Specifically, the CPU 100 can be configured to determine that the trigger active edge represents the end of an irregular region of the crank signal or the cam-edge signal when the count value of the angle counter 260*c* becomes a value corresponding to an active edge appearing at the end of the irregular region of the crank signal or the cam-edge signal.

In the embodiment, in step S400 of FIG. 7, the CPU 100 is configured to determine that a trigger active edge for the crank-edge or cam-edge interrupt task represents the head of an irregular region of the crank signal or cam-edge signal based on the count value of the angular counter 260*c*. The CPU 100 can be configured to determine that a trigger active edge for the crank-edge or cam-edge interrupt task represents the head of an irregular region of the crank signal or cam-edge signal based on information except for the count value of the angular counter 260*c*.

In the embodiment, in step S600 of FIG. 10, the CPU 100 is programmed to determine whether the trigger active edge for the cam-edge interrupt task represents an active edge constituting an irregular region of the cam-edge signal based on the combination of the signal levels of the first and second cam signals, but the present invention is not limited to the structure.

Specifically, the CPU 100 can be programmed to determine whether the trigger active edge for the cam-edge interrupt task represents an active edge constituting an irregular region of the cam-edge signal based on whether the count value of the angular counter 260*c* becomes a value corresponding to an active edge appearing in an irregular region of the cam-edge signal.

In the embodiment, an edge-to-edge interval measured at the head of an irregular region of the crank signal or the cam-edge signal is secured as the multiplication-clock reference time (see step S414 of FIG. 7 and step S634 of FIG. 10). The angle clock is generated based on the secured edge-to-edge interval at the end of the irregular region of the crank signal or the cam-edge signal.

Even if the multiplication-clock reference time is fixed to the edge-to-edge interval at the head of an irregular region of the crank signal or the carn-edge signal set forth above, during the operating conditions of the engine being rapidly changed, the signal-level changes in the rank signal or the cam-edge signal may be greatly different before and after the start of an irregular region of the crank signal or the cam-edge signal. This may result that the edge-to-edge interval at the head of an irregular region of the crank signal or cam-edge signal can not sufficiently reflect the change in the signal levels in the irregular region of the crank signal or the cam-edge signal.

In view of such circumstances, the multiplication-clock reference time is not merely fixed to an edge-to-edge interval at the start of an irregular region of the crank signal or the cam-edge signal, but can be fixed to a previously corrected edge-to-edge interval at the start of the irregular region.

Specifically, in steps S400, S610, and S620, when the trigger active edge for the crank-edge or cam-edge interrupt task represents the head of an irregular region of the crank signal or the cam-edge signal, the microcomputer 30 can correct the edge-to-edge interval based on predetermined correction rules in steps S412, S612, and S622. Thereafter, the microcomputer 30 can store, in the register 230*a*, the corrected edge-to-edge interval as the fixed multiplication-clock reference time. It is preferable that the microcomputer 30 can correct an edge-to-edge interval at the end of an irregular region of the crank signal or the cam-edge signal based on predetermined correction rules in steps S380 and S632.

The predetermined correction rules can be freely determined to allow an edge-to-edge interval at the head of an irregular region or during an irregular region of the crank signal or the cam-edge signal to be properly corrected.

For example, the predetermined correction rules can be designed to correct, to a value, an edge-to-edge interval when the trigger active edge for the crank-edge or cam-edge interrupt task represents the head of an irregular region of the crank signal or the cam-edge signal or is locates within the irregular region; this value is obtained by multiplying the edge-to-edge interval by a predetermined coefficient.

This allows an edge-to-edge interval when the trigger active edge for the crank-edge or cam-edge interrupt task represents the head of an irregular region of the crank signal or the cam-edge signal or is locates within the irregular region to be corrected to the product of the edge-to-edge interval and the predetermined coefficient. The corrected edge-to-edge interval can be secured as the fixed multiplication-clock reference time.

The predetermined coefficient can be experimentally or logically determined, or can be determined based on parameters when the trigger active edge for the crank-edge or cam-edge interrupt task represents the head of an irregular region of the crank signal or the cam-edge signal or is locates within the irregular region.

The predetermined correction rules can be freely determined to correct an edge-to-edge interval at the head of an irregular region or during an irregular region of the crank signal or the cam-edge signal based on another edge-to-edge interval previously determined before the irregular region.

Specifically, when the trigger active edge for the crank-edge or cam-edge interrupt task represents the head of an irregular region of the crank signal or the cam-edge signal or is locates within the irregular region, the predetermined correction rules allow an edge-to-edge interval in response to the trigger active edge to be corrected based on a previous edge-to-edge interval measured before the trigger active edge.

This allows an edge-to-edge interval at the head of an irregular region of the input signal (crank signal or the cam-edge signal) or within the irregular region to be corrected based on a previous edge-to-edge interval measured before the irregular region. The corrected edge-to-edge interval can be secured as the fixed multiplication-clock reference time; this fixed multiplication-clock reference time can be referenced by the multiplication clock generating module 240 when the module 240 generates the multiplication clock.

For example, an edge-to-edge interval at the head of an irregular region of the crank signal or the cam-edge signal can be corrected by adding thereto a value; this value is obtained by multiplying, by a coefficient less than 1, an edge-to-edge interval measured immediately before the irregular region.

During the operating conditions of the engine being rapidly changed, the signal level in regular regions of the crank signal or the cam-edge signal before the irregular region is expected to be rapidly changed. Thus, such a signal-level change is expected to appear in an edge-to-edge interval before the irregular region of the crank signal or the cam-edge signal.

For this reason, even during the operating conditions of the engine being rapidly changed, correcting an edge-to-edge interval at the head of an irregular region of the input signal based on a previous edge-to-edge interval measured before the irregular region allows an angle clock to be properly generated with consideration of the effect of the rapidly change in the operating conditions of the engine.

For example, in step S412 of FIG. 7, assuming that an edge-to-edge interval (i) at the head of an irregular region is set to "150", and an edge-to-edge interval (i−1) immediately before the edge-to-edge interval (i) is set to "100", the edge-to-edge interval (i) can be corrected to a value CV (175) in accordance with the following equation (2) obtained based on the relationships between the edge-to-edge intervals (i) and (i−1):

$$CV=INT(i)\times\{INT(i)-INT(i-1)\}/2 \quad \text{[Equation 2]}$$

where INT(i) represents the edge-to-edge interval (i), and INT(i−1) represents the edge-to-edge interval (i−1).

Figure 13:
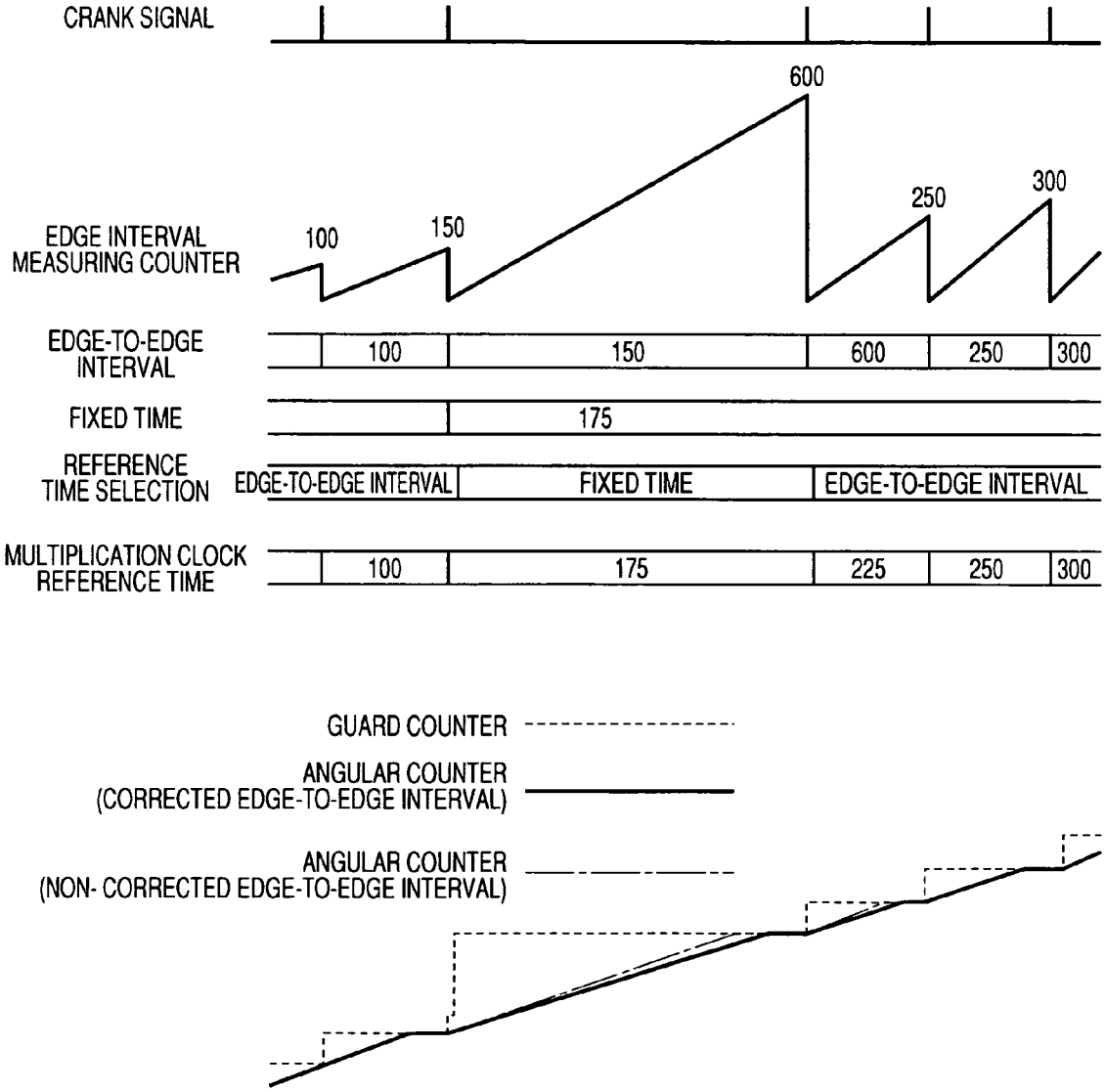
FIG. 13 is a time chart schematically illustrating variations of parameters of the angle clock generating unit with variation of the crank signal when a correction in step S412 of FIG. 7 is carried out.

This correction in step S412 of FIG. 7 is schematically illustrated in the timing chart of FIG. 13.

It is to be noted that, in the timing chart, in step S380 of FIG. 7, assuming that an edge-to-edge interval (j) at the end of the irregular region is set to "600", and an edge-to-edge interval (j−1) immediately before the edge-to-edge interval (j) is set to "150", the multiplication-clock reference time is corrected to a value MT (225) in accordance with the following equation (3):

$$MT=\{INT(j)/k\}+\{INT(j)/k-INT(j-1)\}/2 \quad \text{[Equation 3]}$$

where INT(j) represents the edge-to-edge interval (j), and INT(j−1) represents the edge-to-edge interval (j−1).

In addition, in step S612 of FIG. 10, assuming that an edge-to-edge interval (m) at the head of an irregular region is set to "500", an edge-to-edge interval (m−1) immediately before the edge-to-edge interval (m) is set to "400", and an edge-to-edge interval (m−2) immediately before the edge-to-edge interval (m−1) is set to "300", the edge-to-edge interval (m) can be corrected to a value CV1 (520) in accordance with the following equation (4) obtained based on the relationships between the edge-to-edge intervals (m), (m−1), and (m−2):

$$CV1=INT(m)+\{INT(m-1)-INT(m-2)\}/5 \quad \text{[Equation 4]}$$

where INT(m) represents the edge-to-edge interval (m), INT(m−1) represents the edge-to-edge interval (m−1), and INT(m−2) represents the edge-to-edge interval (m−2).

In addition, in step S622 of FIG. 10, assuming that an edge-to-edge interval (n) at the head of an irregular region is set to "420", and an edge-to-edge interval (n−1) immediately before the edge-to-edge interval (n) is set to "420", the edge-to-edge interval (n) can be corrected to a value CV2 (572) in accordance with the following equation (5) obtained based on the relationships between the edge-to-edge intervals (n) and (n−1), and a timing of signal-level change appearing in the irregular region:

$$CV2=\{INT(n)/(3/4)\}+\{INT(n)/(3/4)-INT(n-1)\}/5 \quad \text{[Equation 5]}$$

where INT(n) represents the edge-to-edge interval (n), and INT(n−1) represents the edge-to-edge interval (n−1).

Figure 14:
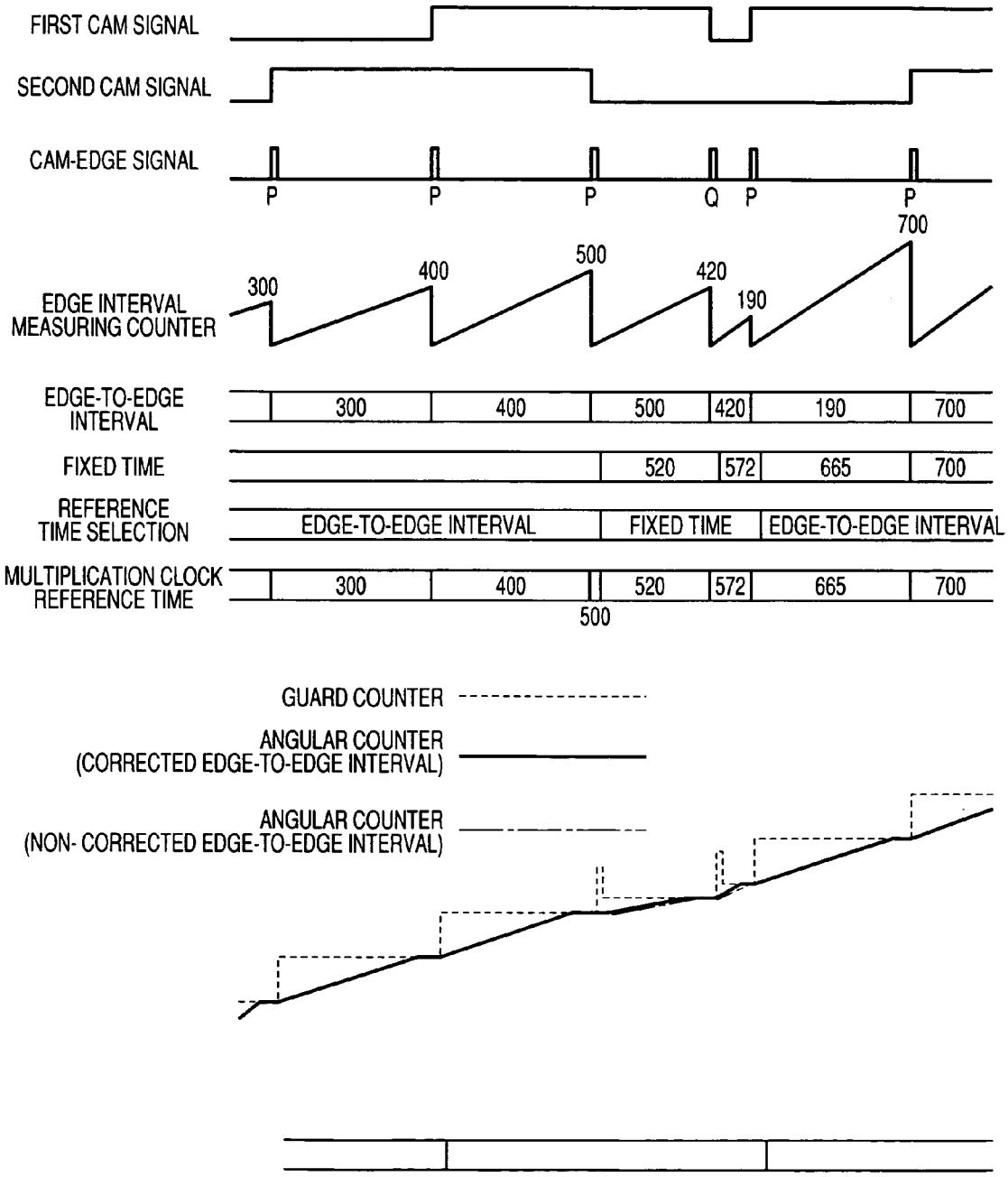
FIG. 14 is a time chart schematically illustrating variations of parameters of the angle clock generating unit with variation of the crank signal when corrections in steps S612 and S622 of FIG. 10 are carried out.

This corrections in step S612 and S622 of FIG. 10 is schematically illustrated in the timing chart of FIG. 14.

It is to be noted that, in the timing chart, in step S632 of FIG. 10, assuming that an edge-to-edge interval (p) at the end of the irregular region is set to "190", an edge-to-edge interval (p−1) immediately before the edge-to-edge interval (p) is set to "420", and an edge-to-edge interval (p−2) immediately before the edge-to-edge interval (p−1), the multiplication-clock reference time is corrected to a value MT1 (655) in accordance with the following equation (6) based on the relationships between the edge-to-edge intervals (p), (p−1), and (p−2):

$$MT1=\{INT(p)+INT(p-1)\}+[\{INT(p)+INT(p-1)\}-INT(p-2)]/5 \quad \text{(Equation 6)}$$

where INT(P) represents the edge-to-edge interval (p), INT (p−1) represents the edge-to-edge interval (p−1), and INT(p−2) represents the edge-to-edge interval (p−2).

In the embodiment, when a failure occurs in the crank signal, the cam-edge signal is used to generate the multiplication clock in place of the crank signal, but the present invention is not limited to the structure.

Specifically, in place of the crank signal, either the first cam signal or the second cam signal can be used to generate the multiplication clock.

In the case of using the first cam signal in place of the crank signal, the edge interval measuring module 220 for example can measure a period between temporally adjacent active edges with regular angular intervals (at regular change points) in the first cam signal except for irregular change points with respect to the regular angular intervals.

Similarly, in the case of using the second cam signal in place of the crank signal, the edge interval measuring module 220 for example can measure a period between temporally adjacent active edges in the second cam signal with regular angular intervals (at regular change points) except for irregular change points with respect to the regular angular intervals.

It is surely that, if a cam signal having a level that repetitively changes in time each time a camshaft rotates by a constant angle, the edge interval measuring module 220 can directly use the cam signal to measure a period between temporally adjacent active edges in the cam signal.

In the embodiment, the counters are designed to count up, but can be designed to count down.

The counters and the registers of the angle clock generating unit 200 can be implemented as hardwired logical circuits installed in the microcomputer 30.

At least part of each of the input circuit 10 and the output circuit 20 can be implemented as hardware logical circuits, software modules, or a hardware/software integrated system installed in the microcomputer 30.

The tasks (1) to (4) to be executed by the CPU 100 can be implemented as hardware logical circuits or a hardware/software integrated system.

In addition, those skilled in the art will appreciate that the present invention is capable of being distributed as program products, for example, the programs stored in the flash ROM 400 in a variety of forms. It is also important to note that the present invention applies equally regardless of the particular type of signal bearing media used to actually carry out the distribution. Examples of suitable signal bearing media include recordable type media such as CD-ROMs and DVD-ROMs, and transmission type media such as digital and analog communications links.

While there has been described what is at present considered to be the embodiment and its modifications of the present invention, it will be understood that various modifications which are not described yet may be made therein, and it is intended to cover in the appended claims all such modifications as fall within the true spirit and scope of the invention.

What is claimed is:

1. An engine control apparatus comprising:

an interval measuring means that sequentially measures, based on an operation signal, an interval between a specified-directed change of a level of the operation signal and a next specified-directed change of the level of the operation signal, the operation signal being composed of a regular region and an irregular region repetitively appearing in time during one cycle of an operation of an engine, the level of the operation signal changing in time in a predetermined direction in the regular region thereof every amount of regular operation of the engine, the level of the operation signal changing in time in the predetermined direction in the irregular region thereof with an amount of irregular operation of the engine;

a measured-value obtaining means that obtains, every time the level of the operation signal changes in the predetermined direction, the measured value measured by the interval measuring means as an interval between the change of the level and a previous change thereof;

a multiplication clock generating means that sets each of the measured values obtained by the measured-value obtaining means as a reference interval and divides, by a predetermined multiplication number, the reference interval so as to generate a multiplication clock having a clock cycle corresponding to a division of the reference interval by the predetermined multiplication number;

an operation count means that serves as a counter that counts the multiplication clock generated by the multiplication clock generating means, when operating conditions of the engine during the one cycle are represented with a resolution calculated by dividing the amount of the regular operation by the predetermined multiplication number, each of the operating conditions being associated with a corresponding one of count values of the counter;

an irregular-region start detection means to detect, based on the operation signal, that a specified-directed level change in the operation signal is a change generated at a start of the irregular region;

an irregular-region end detection means to detect, based on the operation signal, a specified-directed level change in the operation signal is a change generated at an end of the irregular region;

a reference fixing means that fixes the reference interval to a predetermined value when it is detected by the irregular-region start detection means that the predetermined-directed level change in the operation signal is the change of the start of the irregular region; and a reference resetting means that resets the reference interval from the predetermined value fixed by the reference fixing means to each of the measured values measured by the interval measuring means when it is detected by the irregular-region end detection means that the predetermined-directed level change in the operation signal is the change of the end of the irregular region, wherein the engine control apparatus is configured to control the operation of the engine based on a corresponding one of the operating conditions specified by each of the count values of the counter.

2. The engine control apparatus according to claim 1, wherein, when it is detected by the irregular-region start detection means that the predetermined-directed level change in the operation signal is the change of the start of the irregular region, the reference fixing means fixes the reference interval to be referenced by the multiplication clock generating means at the generation of the multiplication clock to one of the measured values measured by the interval measuring means at a time of the detection of the change of the start of the irregular region.

3. The engine control apparatus according to claim 2, further comprising:

when it is detected by the irregular-region start detection means that the predetermined-directed level change in the operation signal is the change of the start of the irregular region, a reference correcting means that corrects, based on a predetermined correction rule, the one of the measured values measured by the interval measuring means at the time of the detection of the change of the start of the irregular region, wherein the reference fixing means fixes the reference interval to be referenced by the multiplication clock generating means at the generation of the multiplication clock to a value corrected by the reference correcting means.

4. The engine control apparatus according to claim 3, wherein, when it is detected by the irregular-region start detection means that the predetermined-directed level change in the operation signal is the change of the start of the irregular region, the reference correcting means corrects, to a correction value, the one of the measured values measured by the interval measuring means at the time of the detection of the change of the start of the irregular region, the correction value being a value to which a product of the one of the measured values measured by the interval measuring means and a preset coefficient is added.

5. The engine control apparatus according to claim 3, wherein, when it is detected by the irregular-region start detection means that the predetermined-directed level change in the operation signal is the change of the start of the irregular region, the reference correcting means corrects the one of the measured values measured by the interval measuring means at the time of the detection of the change of the start of the irregular region based on a measured value measured by the interval measuring means previous to the one of the measured values.

6. The engine control apparatus according to claim 1, wherein the amount of the regular operation is a regular angle of rotation of a crankshaft of the engine, and the amount of the irregular operation is an irregular angle of rotation of the crankshaft, further comprising:

a signal supplying means that supplies, to the interval measuring means, a crank signal as the operation signal, the level of the crank signal regularly changing in time in the predetermined direction in the regular region thereof every regular angle of rotation of the crankshaft, the level of the crank signal irregularly changing in time in the predetermined direction in the irregular region thereof with the irregular angle of rotation of the crankshaft, wherein the multiplication clock generating means generates the multiplication clock having the clock cycle corresponding to the division of the reference interval by a predetermined first multiplication number as the predetermined multiplication number, when rotational positions of the crankshaft, as the operation conditions of the engine, during the one cycle are represented with the resolution calculated by dividing the amount of the regular operation by the predetermined first multiplication number as the predetermined multiplication number, each of the rotational positions being associated with a corresponding one of the count values of the counter, the engine control apparatus controlling the operation of the engine based on a corresponding one of the rotational positions specified by each of the count values of the counter.

7. The engine control apparatus according to claim 6, further comprising:

a first measurement correcting means that, when the reference resetting means resets the reference interval to each of the measured values measured by the interval measuring means in response to it being detected by the irregular-region end detection means that the predetermined-directed level change in the operation signal is the change of the end of the irregular region, corrects the one of the measured values measured by the interval measuring means at a time of the detection of the change of the end of the irregular region based on a measured value measured by the interval measuring means previous to the one of the measured values, wherein, when it is detected by the irregular-region end detection means that the predetermined-directed level change in the operation signal is the change of the end of the irregular region, the multiplication clock generating means generates the multiplication clock having the clock cycle, the clock cycle being defined by dividing the one of the measured values at the time of the detection of the change of the end of the irregular region by the first multiplication number.

8. The engine control apparatus according to claim 6, further comprising:

an abnormality determining means that determines whether the crank signal is abnormal based on a state of the crank signal supplied from the signal supplying means to the interval measuring means, wherein, while it is determined that the crank signal is abnormal, the signal supplying means supplies, to the interval measuring means, a cam signal as the operation signal, the amount of the regular operation is a regular angle of rotation of a camshaft of the engine, and the amount of the irregular operation is an irregular angle of rotation of the camshaft, the level of the cam signal regularly changing in time in the predetermined direction in the regular region thereof every regular angle of rotation of the camshaft, the level of the cam signal irregularly changing in time in the predetermined direction in the irregular region thereof with the irregular angle of rotation of the camshaft, and the multiplication clock generating means generates the multiplication clock having the clock cycle corresponding to the division of the reference interval by a predetermined second multiplication number as the predetermined multiplication number, the second multiplication number being obtained by dividing, by the regular angle of rotation of the camshaft, a product of the regular angle of rotation of the camshaft and the first multiplication number.

9. The engine control apparatus according to claim 8, further comprising:

an irregular-region detection means to detect, based on the operation signal, that a predetermined-directed level change in the operation signal appears within the irregular region, wherein, when it is detected by the irregular-region detection means that a predetermined-directed level change in the operation signal appears within the irregular region, the reference fixing means fixes the reference interval to be referenced by the multiplication clock generating means at the generation of the multiplication clock to a value, the value being obtained by dividing, by a division value, the one of the measured intervals measured by the interval measuring means at a point of time when it is detected that the predetermined-directed level change in the operation signal is the change of the start of the irregular region, the division value being based on a ratio of a timing of an appearance of the predetermined-directed level change within the irregular region to a period of the irregular region.

10. The engine control apparatus according to claim 8, further comprising:

a second measurement correcting means that, when the reference resetting means resets the reference interval to each of the measured values measured by the interval measuring means in response to it being detected by the irregular-region end detection means that the predetermined-directed level change in the operation signal is the change of the end of the irregular region, corrects the one of the measured values measured by the interval measuring means at the time of the detection of the change of the end of the irregular region based on a period, the period being defined as a period from when it is detected that the predetermined-directed level change in the operation signal appears within the irregular region to when it is detected that the predetermined-directed level change in the operation signal is the change of the end of the irregular region, wherein, when it is detected by the irregular-region end detection means that the predetermined-directed level change in the operation signal is the change of the end of the irregular region, the multiplication clock generating means generates the multiplication clock having the clock cycle, the clock cycle being defined by dividing the one of the measured values at the time of the detection of the change of the end of the irregular region by the second multiplication number.

11. A program causing a computer system to function as all of the means recited in claim 1.

* * * * *